US006125613A

United States Patent [19]

Eberhardt, Jr. et al.

[11] Patent Number: 6,125,613

[45] Date of Patent: Oct. 3, 2000

[54] METHOD FOR MODIFYING THE ENVIRONMENT IN A SEALED CONTAINER

[75] Inventors: Mark Edward Eberhardt, Jr.; Richard Hugh Van Camp, both of Troy; Mary Carol Meyer, Tipp City; Nigel Graham Mills, Kettering, all of Ohio

[73] Assignee: Premark FEG L.L.C., Wilmington, Del.

[21] Appl. No.: 09/329,430

[22] Filed: Jun. 10, 1999

Related U.S. Application Data

[62] Division of application No. 09/003,650, Jan. 7, 1998, Pat. No. 6,018,932.

[51] Int. Cl.[7] ..... B65B 31/02

[52] U.S. Cl. ..... 53/432; 53/52

[58] Field of Search ..... 53/86, 89, 90, 53/510, 511, 512, 167, 403, 432, 52

[56] References Cited

U.S. PATENT DOCUMENTS

| | | | |
|---|---|---|---|
| Re. 30,045 | 7/1979 | Greene | 206/455 |
| 1,148,823 | 8/1915 | Bocande . | |
| 1,207,814 | 12/1916 | Stockton . | |
| 1,509,916 | 9/1924 | Waite . | |
| 2,161,071 | 6/1939 | McGrath et al. | 99/171 |
| 2,316,607 | 4/1943 | MacDonald | 119/2 |
| 2,364,126 | 12/1944 | Cantor et al. | 215/43 |
| 2,402,199 | 6/1946 | Macdonald | 99/188 |
| 2,506,769 | 5/1950 | Bergstein | 226/19 |
| 2,638,263 | 5/1953 | Jesnig | 229/62.5 |
| 2,709,519 | 5/1955 | Cushman | 206/65 |
| 2,814,382 | 11/1957 | Lassiter | 206/46 |
| 2,847,313 | 8/1958 | Ellies | 99/174 |
| 2,862,528 | 12/1958 | Geisler et al. | 141/39 |
| 2,863,267 | 12/1958 | Moore . | |
| 3,047,404 | 7/1962 | Vaughn | 99/174 |
| 3,286,430 | 11/1966 | Esty . | |
| 3,348,358 | 10/1967 | Sternau . | |
| 3,360,382 | 12/1967 | Miller | 99/174 |
| 3,445,240 | 5/1969 | Bedrosian et al. | 99/107 |
| 3,516,223 | 6/1970 | Andersen et al. | 53/512 X |
| 3,574,642 | 4/1971 | Weinke | 99/174 |
| 3,610,516 | 10/1971 | Esty | 229/53 |
| 3,625,713 | 12/1971 | Mixon | 99/194 |
| 3,659,393 | 5/1972 | Richter . | |
| 3,673,758 | 7/1972 | Esty . | |
| 3,673,760 | 7/1972 | Canamero . | |
| 3,693,314 | 9/1972 | Reid et al. . | |
| 3,715,860 | 2/1973 | Esty . | |

(List continued on next page.)

FOREIGN PATENT DOCUMENTS

| | | |
|---|---|---|
| 843886 | 6/1970 | Canada . |
| 2351008 | 12/1977 | France . |
| 2244601 | 3/1974 | Germany . |
| 1186978 | 4/1970 | United Kingdom . |
| 2197291 | 5/1988 | United Kingdom . |
| 9116236 | 10/1991 | WIPO . |

*Primary Examiner*—Linda Johnson
*Attorney, Agent, or Firm*—Thompson Hine & Flory LLP

[57] ABSTRACT

A method for controlling an apparatus for exchanging a first gas contained in a sealed container for a second gas while the container is in a chamber. The method comprises the steps of withdrawing the first gas from the container for a predetermined period of time and approximating the head space volume of the container based directly or indirectly upon a change in headspace pressure in the container. The method further includes the step of withdrawing the first gas from the container and air from the chamber under conditions which are dependent upon the approximation of the headspace volume and which reduce the damage to the container due to pressure forces.

18 Claims, 23 Drawing Sheets

U.S. PATENT DOCUMENTS

| | | | |
|---|---|---|---|
| 3,799,427 | 3/1974 | Goglio | 229/62.5 |
| 3,804,962 | 4/1974 | Pipkins | 426/418 |
| 3,851,080 | 11/1974 | Lugg | 426/312 |
| 3,851,437 | 12/1974 | Waldrop et al. . | |
| 3,930,040 | 12/1975 | Woodruff | 426/312 |
| 3,943,987 | 3/1976 | Rossi | 150/5 |
| 3,980,226 | 9/1976 | Franz | 229/62.5 |
| 4,055,672 | 10/1977 | Hirsch et al. | 426/127 |
| 4,066,401 | 1/1978 | Solomon | 21/61 |
| 4,122,197 | 10/1978 | Krugmann | 426/232 |
| 4,170,863 | 10/1979 | Schwanz | 53/511 |
| 4,184,310 | 1/1980 | Shelby | 53/412 |
| 4,272,864 | 6/1981 | Holly | 17/45 |
| 4,338,702 | 7/1982 | Holly | 17/32 |
| 4,349,575 | 9/1982 | Roth | 426/513 |
| 4,424,659 | 1/1984 | Perigo | 53/425 |
| 4,427,705 | 1/1984 | Wyslotsky | 426/106 |
| 4,513,015 | 4/1985 | Clough | 426/396 |
| 4,514,434 | 4/1985 | Goldberger | 426/646 |
| 4,548,824 | 10/1985 | Mitchell | 426/111 |
| 4,548,852 | 10/1985 | Mitchell | 426/111 |
| 4,583,347 | 4/1986 | Nielsen | 53/512 X |
| 4,627,336 | 12/1986 | Nam | 99/467 |
| 4,642,239 | 2/1987 | Ferrar | 426/396 |
| 4,685,274 | 8/1987 | Garwood | 53/433 |
| 4,744,199 | 5/1988 | Gannon | 53/434 |
| 4,768,941 | 9/1988 | Wagner | 425/197 |
| 4,779,398 | 10/1988 | Glandon | 55/434 |
| 4,919,955 | 4/1990 | Mitchell | 426/394 |
| 5,228,269 | 7/1993 | Sanfilippo et al. | 53/510 X |
| 5,348,752 | 9/1994 | Gorlich | 426/129 |
| 5,419,096 | 5/1995 | Gorlich | 53/432 |
| 5,481,852 | 1/1996 | Mitchell | 53/432 |
| 5,551,213 | 9/1996 | Koelsch | 53/510 X |
| 5,961,000 | 10/1999 | Sanfilippo et al. | 53/432 |

INITIAL CO SETTINGS FOR SMALL HEADSPACE ALGORITHM

| PWMNL20 | CO |
|---|---|
| ≤ 30 | 15 |
| > 30 & ≤ 40 | 12 |
| > 40 & ≤ 50 | 9 |
| > 50 & ≤ 90 | 6 |
| > 90 & ≤ 130 | 4 |
| > 130 | 2 |

FIG. 24

INITIAL CO AND PWM SETTINGS FOR LARGE HEADSPACE ALGORITHM

| PWMNL250 | CO |
|---|---|
| ≤ 65 | 10 |
| > 65 & ≤ 74 | 9 |
| > 74 & ≤ 83 | 8 |
| > 83 & ≤ 92 | 7 |
| > 92 & ≤ 101 | 6 |
| > 101 & ≤ 110 | 5 |
| > 110 & ≤ 119 | 4 |
| > 119 & ≤ 128 | 3 |
| > 128 & ≤ 137 | 2 |
| > 137 | 1 |

| PWMNL250 | PWM |
|---|---|
| ≤ 14 | 20 |
| > 14 & ≤ 21 | 30 |
| > 21 & ≤ 28 | 40 |
| > 28 & ≤ 35 | 50 |
| > 35 & ≤ 42 | 60 |
| > 42 & ≤ 49 | 70 |
| > 49 & ≤ 56 | 80 |
| > 56 & ≤ 75 | 90 |
| > 75 | 100 |

FIG. 25

METHOD FOR MODIFYING THE ENVIRONMENT IN A SEALED CONTAINER

This application is a divisional of Ser. No. 09/003,650, filed on Jan. 7, 1998 now U.S. Pat. No. 6,018,932.

The present invention is directed to a method for carrying out a gas exchange, and more particularly, to a method for modifying the environment in a sealed container, such as a package of meat.

BACKGROUND OF THE INVENTION

When packaging meat or other perishable products, it is often desirable to enclose the product in a preservative environment. For example, when packaging meat, it may be desired to provide an $N_2$—$CO_2$ atmosphere in the container to prolong the shelf-life of the meat. However, when meat is packaged in $N_2$—$CO_2$, it may turn an unappealing purple color due to a lack of oxygen in the surrounding gas. It is known that this coloring effect may be countered by removing the oxygen-poor environment and replacing it with an oxygen-rich atmosphere, which allows the meat to "bloom" and return to its more visually appealing red color before the meat is shelved and displayed to customers.

When carrying out this gas exchange procedure, it has been found to be more effective when a substantial portion of the oxygen-poor gas is removed prior to the introduction of the replacement gas. The oxygen-poor gas may be extracted by drawing a vacuum within the meat container. However, the pressure differential between the container and the container environment may cause the container to rupture or collapse during evacuation. Accordingly, it is desirable to control the pressure around the container during gas exchange. In this manner a corresponding vacuum may be drawn in the surrounding environment during gas exchange, thereby effectively nullifying the large pressure differential between the container and its environment. This procedure has been found to protect the container from pressure damage.

The use of an apparatus to exchange a first gas within a container for a second gas is known. For example, U.S. Pat. No. 4,919,955 to Mitchell discloses a method and apparatus for packaging perishable products. The invention disclosed therein comprises a relatively rigid tray which is sealed with a flexible gas impermeable cover, the tray being provided with a resealable septum valve. The tray is also preferably provided with a plurality of protrusions or mounds to facilitate gas flow and gas contact with the packaged product. Furthermore, U.S. Pat. No. 5,481,852 to Mitchell discloses a vacuum chamber provided with a means to align a sealed receptacle such that a gas exchange probe may be inserted into the receptacle through a resealable valve. The gas exchange probe establishes flow communication between the interior of the receptacle and a vacuum chamber. A vacuum is then drawn in the chamber, and the interior of the receptacle is evacuated through the flow probe. The coordinated vacuums help to prevent the distortion or collapse of the flexible receptacle.

While the apparatus disclosed in U.S. Pat. No. 5,481,852 is useful in performing the gas exchange process, there are numerous drawbacks in the apparatus which make it undesirable for commercial use.

SUMMARY OF THE INVENTION

The present invention is an apparatus for exchanging a first gas contained in a sealed container with a second gas, the apparatus comprising a vacuum chamber for receiving the container and for maintaining a controlled pressure about the container. The invention further comprises a gas exchange head for exchanging gas in the container while maintaining a seal between the container and the surrounding chamber, and a vacuum pump coupled to the gas exchange head and to the vacuum chamber for evacuating the first gas from the container and air from the chamber. The apparatus further has a gas source for supplying the second gas, the gas source being coupled to the gas exchange head for supplying the second gas to the container, and a sensor for monitoring the pressure in the container during gas exchange. The sensor has a separate port in the container for sensing container pressure, which is more accurate and responsive than utilizing a port that is shared with the vacuum pump path. The present invention further provides for a controller for adjusting the rate with which the first gas is removed from the container and the rate at which the chamber is evaluated such that the container is not damaged, and the controller can also adjust the rate at which gas is supplied to the container and the rate with which the chamber is pressurized so as not to damage said container during the fill procedure.

In accordance with a preferred embodiment of the invention, a container is placed into the chamber. A set of valves are provided to control the flow of gases into and out of the container and the chamber. The size, and more specifically, the head space volume, of the container is determined. Based upon this determination, either a large or small container algorithm for evacuating and filling the container is selected, and the initial values for the valves are assigned based upon this determination. The determination of head space volume can be accomplished by a method in which a series of pulse width modulated valves, which control the flow of gas in and out of the container through the gas exchange head, and a series of chamber orifice valves, which control the gas flow in and out of the chamber, are both set to a predetermined opening. A vacuum is then drawn in the container and in the chamber for a predetermined period of time and the differential pressure between the container and the chamber is then measured. By examining the differential pressure, the relative size of the container can be approximated. Based upon this approximation, either a large container procedure or a small container procedure for carrying out the gas exchange is selected. An alternate method by which the large container or small container method is chosen includes the steps of setting the pulse width modulated valves and the chamber orifice valves to a predetermined opening, and drawing a vacuum in the container and the chamber for a predetermined period of time while adjusting the pulse width modulated (PWM) valves to achieve a predetermined pressure differential between the chamber and the container. The end PWM setting is indicative of the headspace volume. The large container procedure or small container procedure is then selected based on the end pulse width modulated valve setting.

Once the container size has been determined, the gases are evacuated from the chamber and the container following either the large container or small container procedure. The gas flows are coordinated using the appropriate large container procedure or small container procedure. The large container procedure or small container procedure, also termed the vac/fill algorithms, operate so as to maintain a slight positive pressure differential in the container relative to the chamber. By monitoring the differential pressure throughout the gas exchange operation, and comparing the measured differential pressure to a target differential pressure, the gas in the container is removed and replaced without damaging the container.

Another manifestation of the invention is a method for controlling an apparatus for exchanging a first gas in a sealed container for a second gas while the sealed container is in a vacuum chamber. The method comprises the steps of selecting a large container procedure or a small container procedure, and drawing a vacuum in the sealed container to remove the first gas. The vacuum is adjusted during this step by a controller which adjusts the flow rates out of the container and the chamber, the flow rates varying depending on whether the large container procedure or the small container procedure is selected. The method further comprises the step of releasing the second gas into the container, the release being adjusted by a controller which adjusts the flow rate of gas into the container, the flow rate varying depending on whether the large container procedure or the small container procedure is selected. The method further comprises the step of maintaining a controlled pressure differential between the sealed container and the chamber during the drawing and releasing steps.

The apparatus of the present invention preferably employs a unidirectional binary-weighted orifice manifold to control evacuation and pressurization of the vacuum chamber. The orifice manifold includes a plurality of individually actuable one way control valves connected in parallel. Each valve is connected on one end to a valve inflow pipe and on the other end to a valve outflow pipe. Each valve preferably has a different cross-sectional area to allow for greater control of the chamber orifice manifold. The manifold further includes a two-way exhaust valve coupled on one end to the valve inflow pipe and on the other end to a vacuum pump, and a two-way vacuum pump valve coupled on one end to the valve outflow pipe and on the other end to the gas source. The orifice manifold further comprises a three way valve coupled to the valve inflow pipe, valve outflow pipe, and the chamber.

The invention also provides for a gas exchange head to allow gas communication and exchange while maintaining a seal between the container and the chamber. The gas exchange head includes an inner cylinder or rod, an intermediate sleeve, and an outer cylinder having vacuum seal points between them. The outer cylinder is located outside and coaxial with the intermediate sleeve, and includes a lower cup portion at its distal end for sealing an aperture in the chamber. The aperture provides access for the gas exchange head to the container. The outer cylinder is reciprocatingly mounted on the intermediate sleeve. The gas exchange head further includes a spring coaxially mounted on the outer cylinder for biasing the lower cup portion into sealing engagement with the chamber, and an inner cylinder adapted at its distal end to receive and retain the probe. The inner rod is located inside and coaxial with the intermediate sleeve and is axially moveable relative to the intermediate sleeve, whereby the flow probe may be reciprocated from a retracted position to an exposed position. The intermediate sleeve is stationarily fixed on a mounting block.

The chamber preferably includes switches positioned such that when the container is placed in the chamber in an orientation which insures appropriate interfacing with the gas exchange head, the switches are activated, thus allowing the gas exchange operation to proceed. Preferably, the switches include a pair of corner switches which are maintained in an open condition by a spring. Adjacent sides of the properly oriented container exert a force sufficient to close the switches.

In a further embodiment of the invention the chamber includes a platform and an elevator mechanism to support the container and allow the container to be raised to a height sufficient to properly interface with the gas exchange head. The elevator mechanism is connected to the platform through at least one orifice on the floor of the chamber, and the connections include gaskets to prevent leaks during the vacuum and fill processes. The vertical movement of the elevator is regulated by a sensor which detects the top edge of the container. Preferably, the sensor consists of a fiber optic beam which is positioned to detect when the top edge of the container, after which the elevator continues its upward movement for a predetermined distance and stops.

In a further embodiment of the invention, the chamber employs a door assembly to seal and allow access to the vacuum chamber. The door assembly comprises a door movable from an open position in which the door is raised with respect to an opening in the chamber to a closed position in which the door covers the opening. The door assembly further includes an upper linkage and a lower linkage coupled to each side of the door, the linkages being further coupled to a support bracket, with the support bracket being flexibly mounted to the chamber such that the bracket is able to move laterally as the door is sealed with respect to the chamber. The door assembly further comprises a closure cylinder mounted to the chamber for drawing the door into presealing contact with the chamber so that the chamber can be evacuated, the door being drawn into tighter contact with the chamber as the chamber is evacuated, wherein the bracket is displaced laterally as the door is drawn into sealing contact with the chamber.

The present invention will be more fully understood and appreciated by reference to the following description, the accompanying drawings and the appended claims.

BRIEF DESCRIPTION OF THE DRAWINGS

FIG. 24 is a lookup table for setting the chamber orifice valves during execution of the control algorithm;

FIG. 25 is a lookup table for setting the chamber orifice and pulse width modulated valves during execution of the control algorithm;

DETAILED DESCRIPTION

Figure 1:
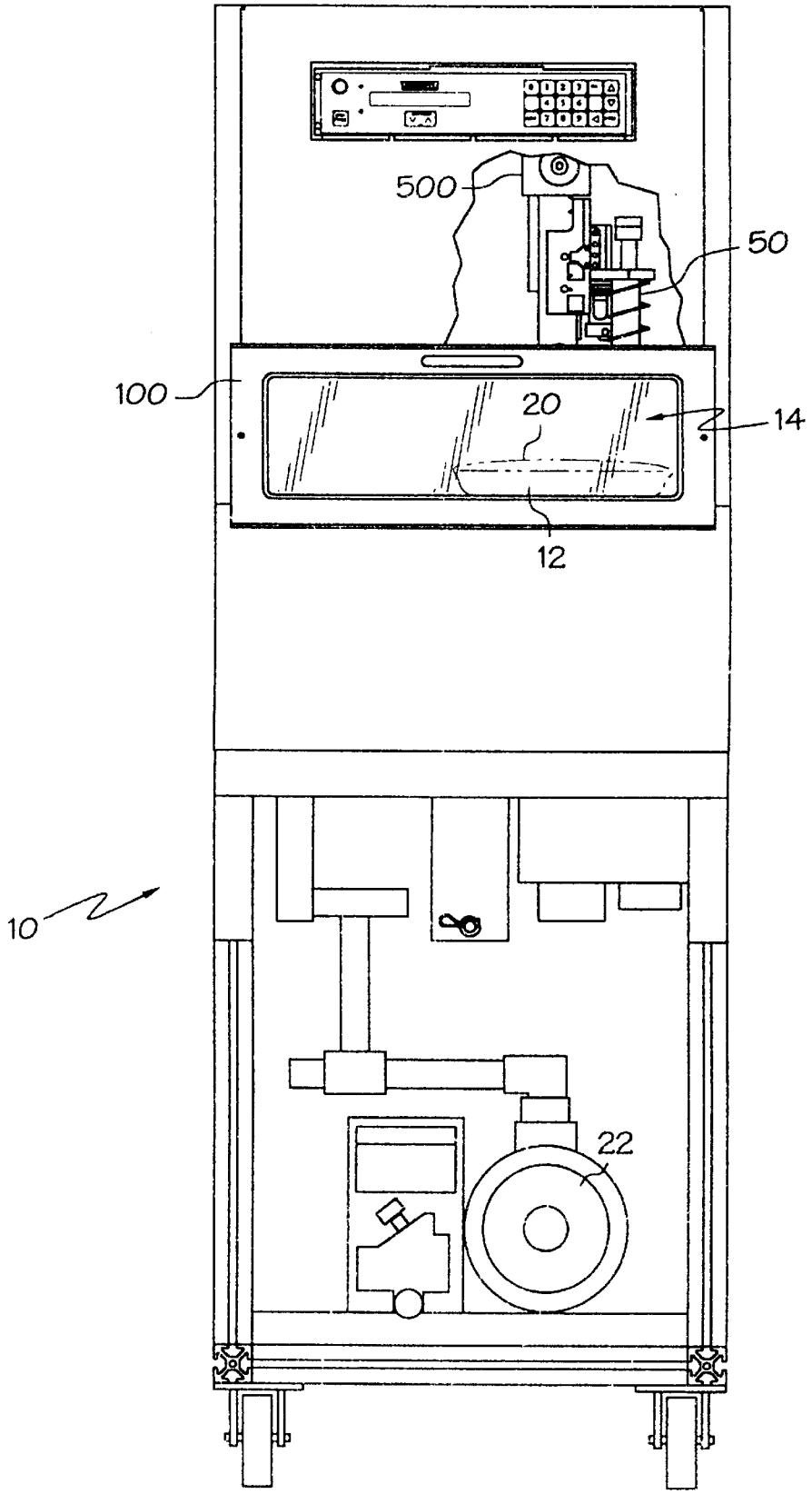
FIG. 1 is a partial cutaway front view of the gas exchange apparatus of the present invention.
Figure 2:
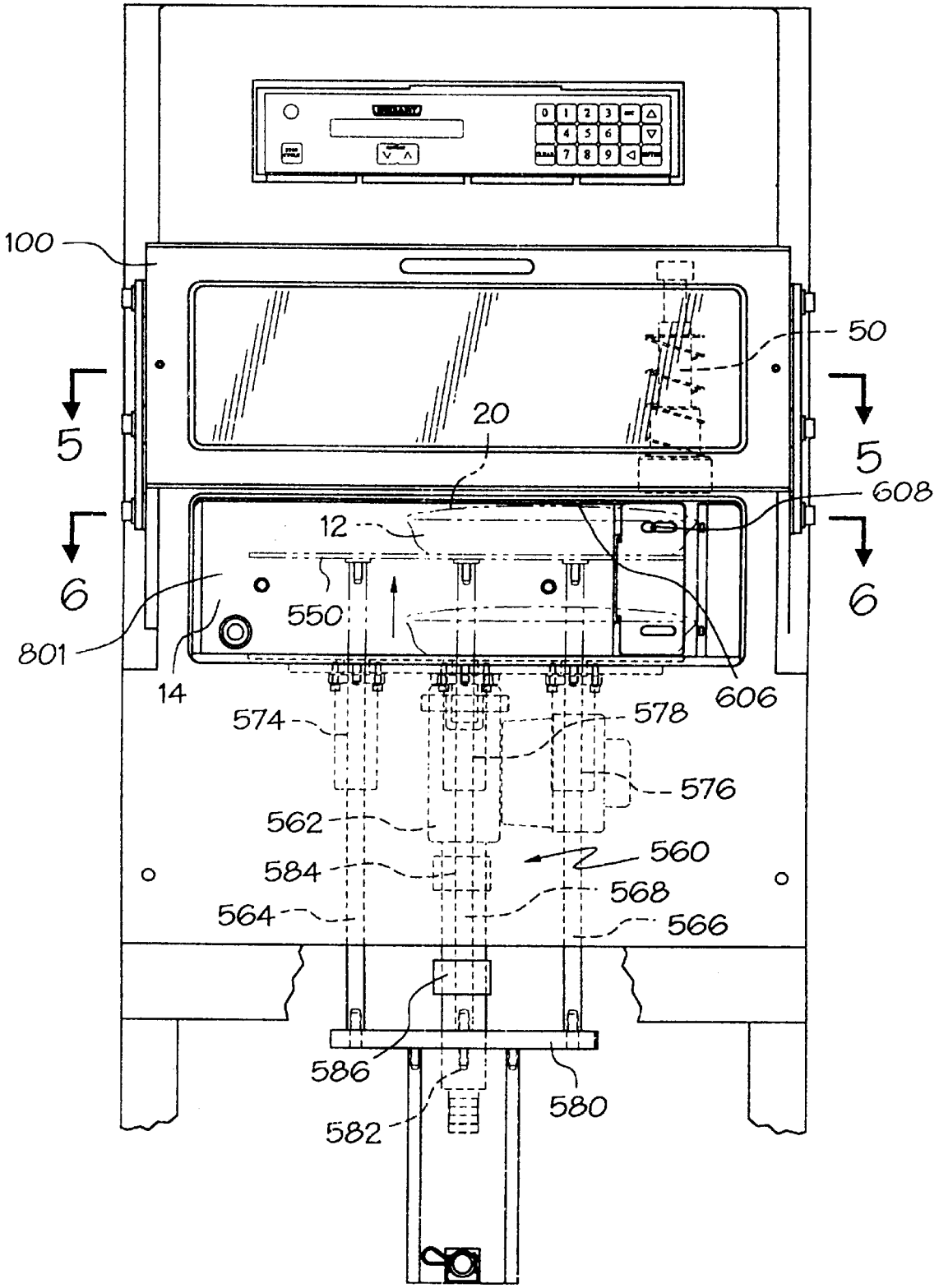
FIG. 2 is a detailed front view of the gas exchange apparatus of FIG. 1 with the door in the open position.
Figure 3:
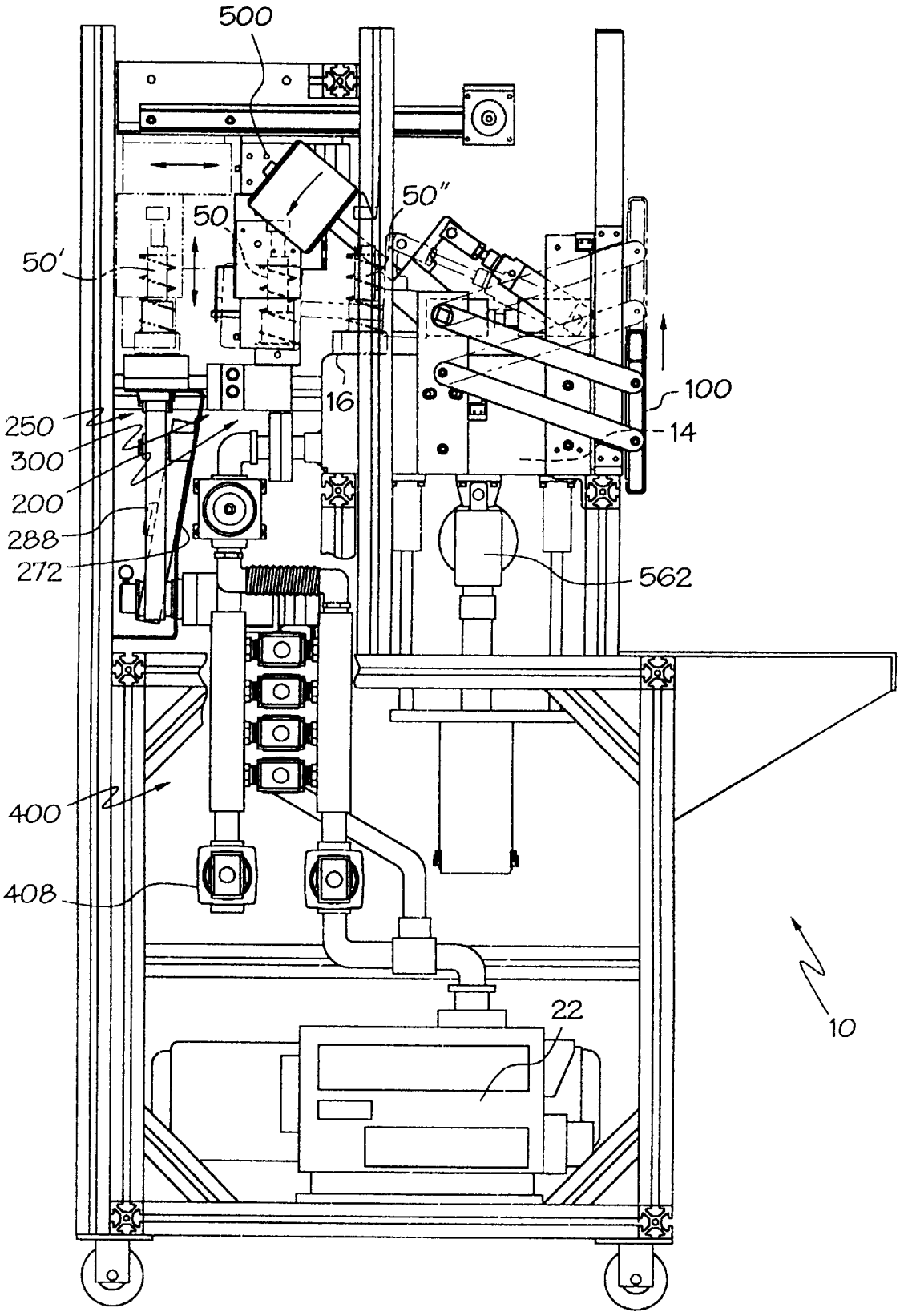
FIG. 3 is a side elevational view of the gas exchange apparatus of FIG. 1, with the side outer housing removed.

As shown in FIGS. 1–3, the gas exchange apparatus, generally designated 10, includes a vacuum chamber 14 for receiving a container 12 having an outer lid or wrapping 20. The apparatus includes a seal pick up station 250, a probe check station 200, a sanitizing station 300, a gas exchange head 50, a chamber orifice manifold 400, and a vacuum pump 22.

GAS EXCHANGE HEAD

Figure 9:
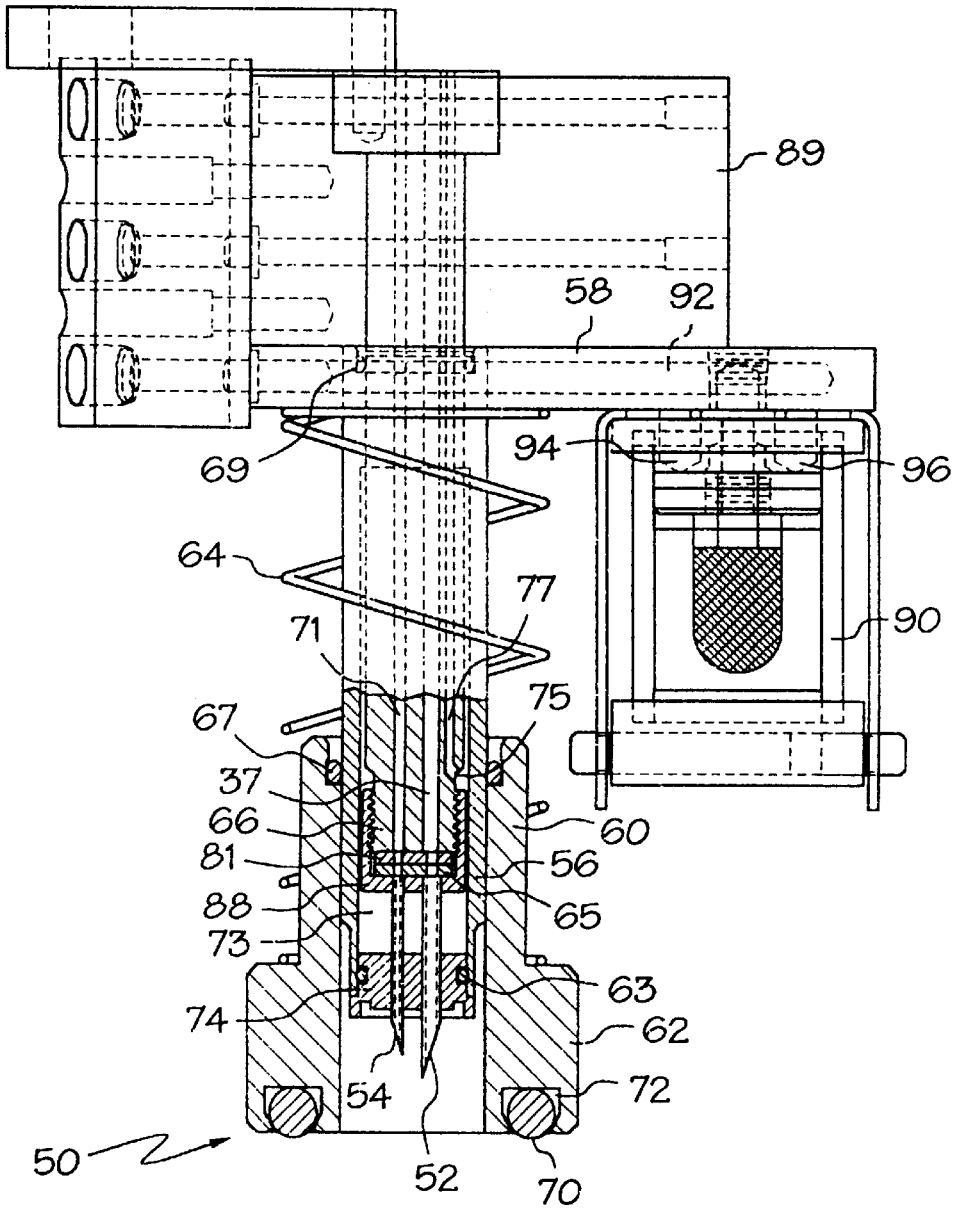
FIG. 9 is a partial cross-sectional view of the gas exchange head of the present invention.

As shown in FIG. 9, the gas exchange head 50 includes a flow probe 52 and sense probe 54. In one embodiment, the flow probe is a 12 gauge needle, and the sense probe is a 16 gauge needle. The gas exchange head 50 enables the evacuation of the head space volume of the container 12 and the subsequent filling of the container with the replacement gas. The term head space volume, or simply head space, is used herein to represent the capacity of the container to receive a gas; that is, the volume not occupied by the product contained in the container. The gas exchange head 50 is coupled to the vacuum pump 22, a gas supply 24, and a vent valve by a manifold 89, and the chamber 14 is coupled to the vacuum pump 22 and to a vent valve 418 via a chamber orifice manifold 400. These manifolds allow for control of the differential pressure between the chamber and container during gas exchange. The gas exchange head 50 includes an intermediate sleeve 56 which is fixed to a mounting block 58 which is, in turn, fixed to the linear actuator 500. This allows the gas exchange head 50 to be moved as a unit to the various stations in the apparatus. Outer cylinder 60 is located outside the intermediate sleeve 56, and is coaxial with the sleeve 56. Inner cylinder or rod 66 is mounted inside of the intermediate sleeve 56 and is coaxial with the intermediate sleeve 56.

Inner cylinder 66 includes a threaded cap 88 at its distal end to couple plate 81 which carries the flow probe 52 and the sense probe 54 to the inner cylinder 66. In a preferred embodiment the flow probe 52 and sense probe 54 are welded to a plate 81, and the plate 81 is seated within the internally threaded affixing cap 88. Seal 65 is placed immediately below the plate 81. The affixing cap 88 may then be screwed onto a correspondingly threaded end of the inner cylinder 66. The flow probe 52 and sense probe 54 are thereby easily replaceable as a unit. Cap 88 can be easily removed and replaced if either probe is broken or clogged. The inner cylinder 66 is also coupled to a pneumatic cylinder 98 (shown in FIGS. 26 and 27) which axially reciprocates the inner cylinder 66 relative the intermediate sleeve 56. In this manner the flow probe 52 and sense probe 54 can be reciprocated from a position in which they are retracted inside the gas exchange head 50 to a position which they are exposed and extend below the intermediate sleeve 56, as shown in FIG. 9.

The outer cylinder 60 is mounted such that it is free to move axially with respect to the intermediate sleeve 56, and is spring biased in the downward direction by the spring 64. Spring 64 urges the outer cylinder 60 and cup portion 62 into sealing engagement with the chamber 14 when the outer cylinder 60 is pressed against the top surface of the chamber 14 to cover the aperture 16. The spring biased nature of the outer cylinder 60 also allows the gas exchange head to compensate for height tolerance variations in the chamber and other system components.

The inner cylinder 66 has two separate flow 37 and sense 71 passageways machined therein which permit accurate and responsive container pressure sensing and thereby allows accurate and responsive process control for all container sizes. Inner cylinder 66 also has a vacuum pathway 77 for pick up of the seals formed therein. Pressure sensing probe 54 is coupled to the sense line 71, and flow probe 52 is coupled to the flow line 37. By providing a separate pressure sensing probe 54, more accurate and responsive measurements are obtained than if a common flow and sense probe was used. The three coaxial cylinders—the intermediate sleeve 56, inner cylinder 66 and the outer cylinder 60—have free relative motion to each other with two vacuum seal points between them. This allows for integration of relative motion, sealing and conduit capabilities into a compact gas exchange head.

Outer cylinder 60 further includes a lower cup portion 62 at its distal end which preferably includes an annular slot 72 adapted to retain a foam cord ring 70. In a preferred embodiment, the outer cylinder 60 is made of Teflon® impregnated acetal. A vertical groove inside the outer cylinder wall (not shown) aligns the outer cylinder and provides a track for the vertical movement of the outer cylinder. Seals 63, 65, 67 and 69 seal the various components of the gas exchange head relative each other.

Figure 10:
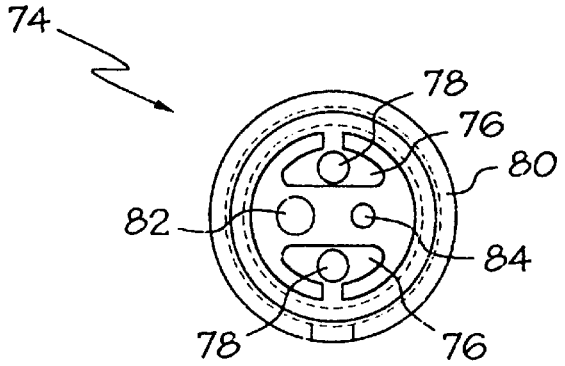
FIG. 10 is a front view of the seal pickup plate of the present invention.

The central chamber 73 of intermediate sleeve 56 is connected via port 75 and vacuum line 77 to the vacuum pump 22 to provide a vacuum at the face of the pickup plate 74 to retain a seal thereon, and is sealed with respect to the remaining component of the gas exchange head 50. The vacuum passes from the port 75 to the central chamber 73 by a plurality of axial grooves (not shown) formed in the cap 88. The central chamber 73 is ported to the pickup plate by through-holes 78 (FIG. 10). Seal pickup plate 74 is coupled to the distal of the intermediate sleeve 56. The pick up plate 74 further has an aperture 82 which provides a through-hole for the flow probe 52, and aperture 84 provides a through-hole for the sense probe 54. Apertures 82 and 84 allow the flow probe 52 and sense probe 54 to pass through the pickup plate 74 when they are lowered by a pneumatic cylinder 98. In a preferred embodiment, the intermediate sleeve 56 has a shallow radial groove at its distal edge, and seal pickup plate includes corresponding ring which mates with the shallow radial groove to thereby couple the pickup plate 74 to the sleeve 56.

Pickup plate 74 is used in stripping seals from the probes. Once the gas exchange head has picked up a seal 18 on the seal pickup plate 74, the gas exchange head moves to the aperture 16, pierces the container and applies the seal 18, and executes the gas exchange. The inner cylinder 66, along with the flow probe 52 and sense probe 54, are then retracted while the pick-up plate 74 remains in contact with the container, thereby holding the seal 18 in place on the container 12 and stripping the seal from the probes as the flow probe 52 and sense probe 54 are withdrawn.

The pickup plate 74 picks up and retains a seal 18 its lower face. As shown in FIG. 10 the seal pickup plate 74 has a plurality of holes formed therein, and a pair of recessed faces 76. The recessed faces 76 are coupled to the vacuum pump 22 through the intermediate sleeve 56, via vacuum through-holes 78. Each seal 18 to be picked up is retained on a seal supply roll 252 by an adhesive, and therefore some force is required to separate the seal from the carrier. The seal 18 is pulled away from the roll 252 by the face of the pickup plate 74 through vacuum forces provided by the vacuum pump. The recessed faces 76 provide an increased surface area to provide a greater vacuum force on the seal 18. To aid in separating the seal 18 from the seal supply roll 252, a perimeter ring 80 is provided on the pickup plate 74. As will be discussed in greater detail below, the perimeter ring 80 mates with a corresponding groove 254 on the seal pickup station 250, and various controlled movements of the gas exchange head 50 may be used to separate the seals 18. The perimeter ring 80 and groove 254 interact to mechanically loosen the seal 18 from the seal supply roll 252. It will be appreciated that the groove 244 and ring 80 could be reversed and the groove could be provided in plate 74.

A particle collection cup 90 is provided on the gas exchange head 50 and connected to the flow probe vacuum path by a vacuum conduit 92. Particle collection cup 90 provides a receptacle for any foreign particles which might be sucked through the flow probe 52 during the vacuum step. Air enters the collection cup at entry port 94 and exits at exit port 96. Due to the expansion of the gas at entry port 94, any foreign particles in the gas flow drop to the bottom of the cup 90. As a further precaution, a fine mesh screen is placed at the exit port 96 to catch the particles. Preferably, the particle collection cup 90 is transparent to allow for visual inspection of the cup.

Mounting block 58 receives the intermediate sleeve 56 and is coupled to the linear motion system 500. In the illustrated embodiment, machined passageways are formed in the mounting block 58 to port the gas or vacuum flows to required points in the apparatus while minimizing the use of loose tubes that may interfere with free motion of the system. The mounting block 58 also provides the vacuum conduit 92 which ports the vac/fill line 37 from the gas exchange head 50 to the collection cup 90. The sense path 71 and the vacuum path for the seal pickup 77 are connected to the manifold 89 by flexible tubing (not shown). In a preferred embodiment of the invention, the gas exchange head passageways in inner cylinder 66 are designed such that the assembly can be brushed or swabbed through the gas passageways in a straight line fashion to allow for easy cleaning.

Figure 16A:
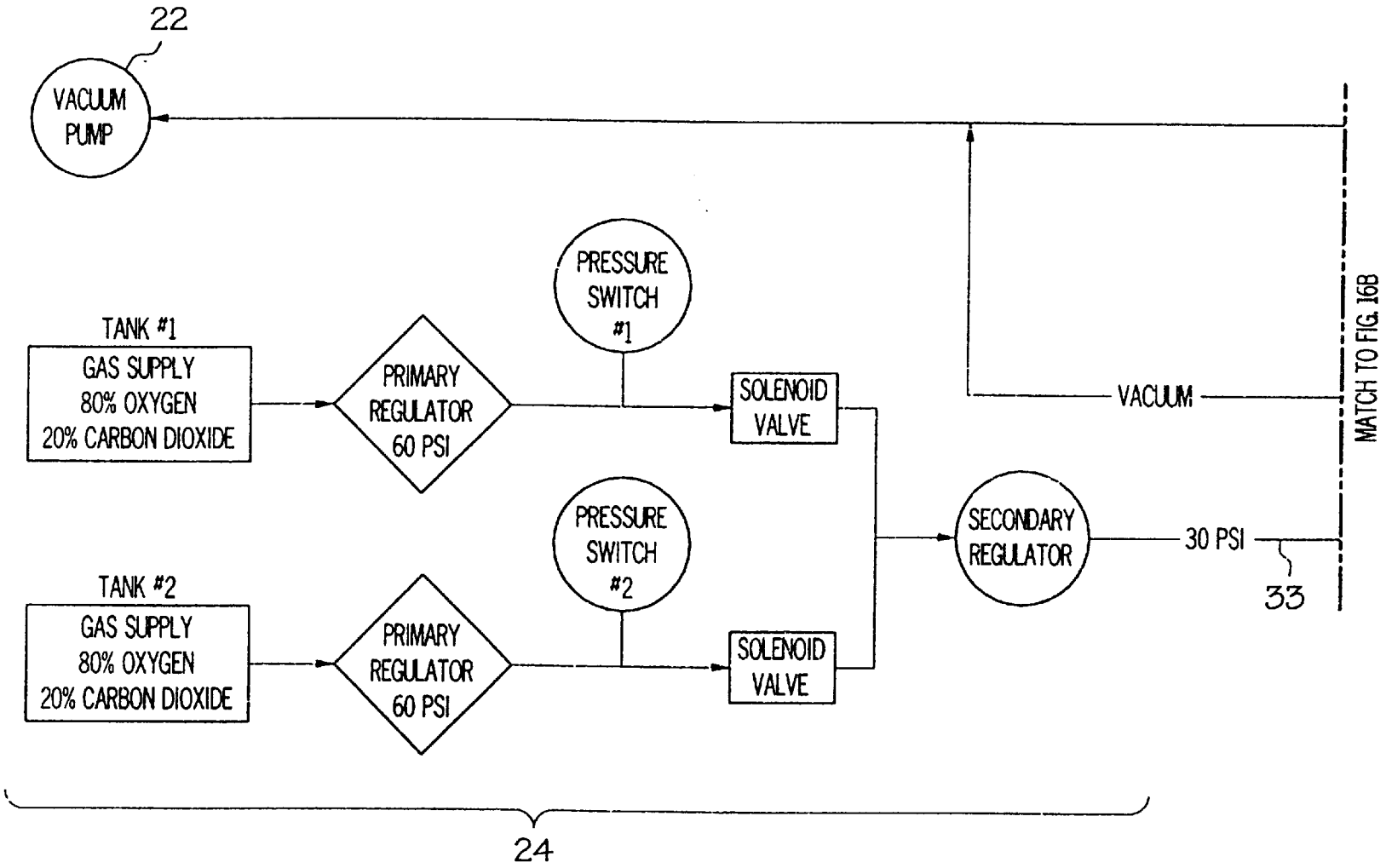
FIG. 16 is a schematic representation of the connections to and from the gas exchange head and chamber of the present invention.
Figure 16B:
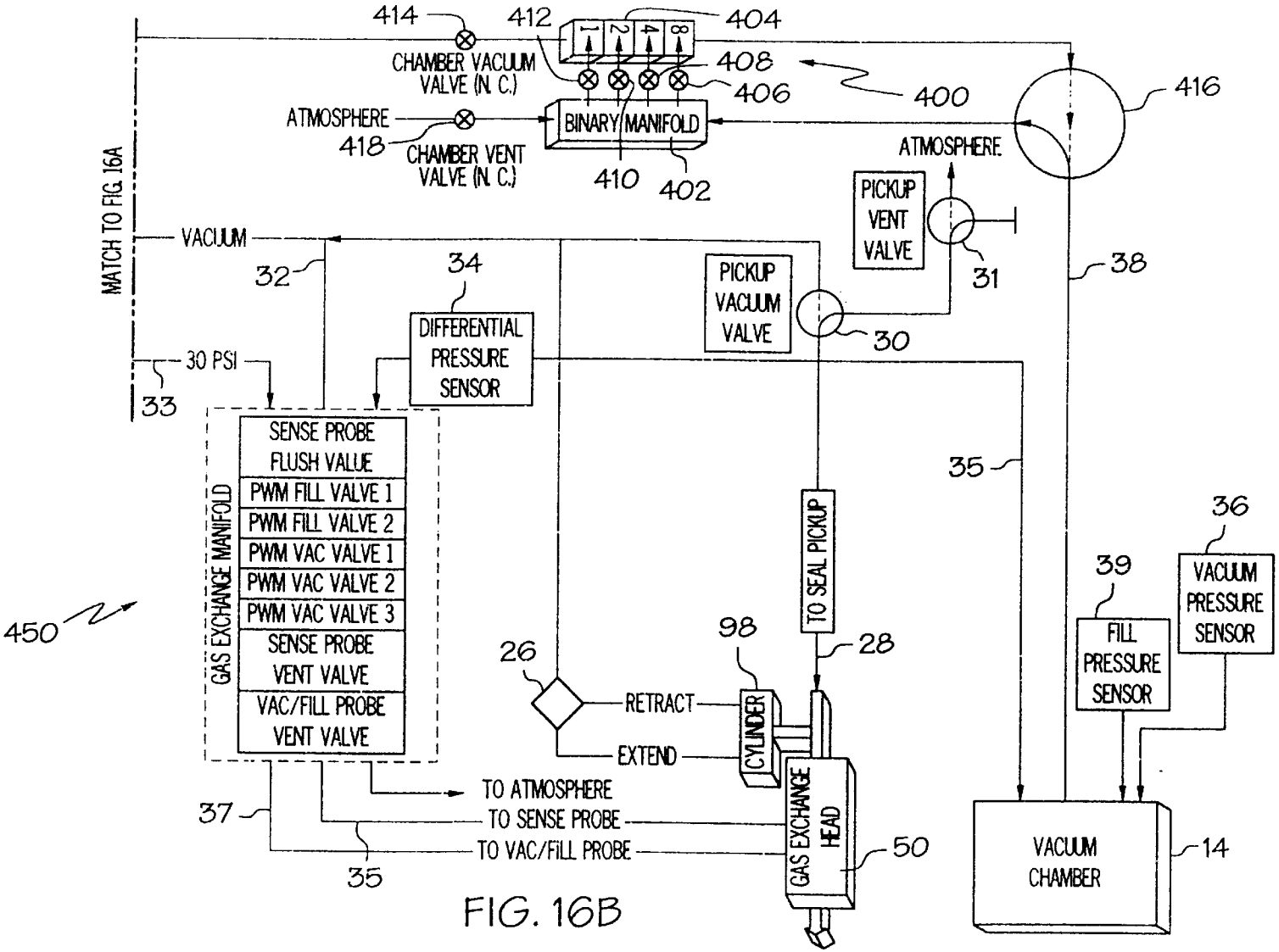

FIG. 16 is a schematic representation of the vacuum and fill connections coupled to the vacuum chamber 14 and to the gas exchange head 50. As discussed earlier, the gas exchange head 50 is vertically movable by means of the actuating cylinder 98. The cylinder 98 is in turn coupled to the vacuum pump 22 by 4-way valve 26, which powers the lowering and raising of the cylinder 98. The vacuum line which passes through the gas exchange head for seal pickup is shown as vacuum line 28. A 3-way valve 30 controls the connection between the seal pickup vacuum line 28, the vacuum pump 22 and vent valve 31 to vent the seal pickup line 77 to release the vacuum in chamber 73 between the seal pickup plate and the inner cylinder 66. The chamber 73 is vented twice during the gas exchange process. Upon inserting the probes into the container, venting the chamber 73 provides an additional force to urge the seal into contact with the outer wrapping or lid. Upon extraction of the probes, the venting releases the vacuum on the seal and enables the inner cylinder to be retracted.

The vacuum line 32 for evacuating the container passes through the gas exchange manifold 450 and then enters the gas exchange head 50 via vac/fill line 37. Manifold 450 includes a sense probe flush valve 452(FIG. 14); a first PWM fill valve 454; a second PWM fill valve 456; first, second and third PWM vacuum valves 458, 460 and 462; a sense probe vent valve 464 and a flow probe vent valve 466. The vac/fill line 37 may be vented to atmosphere through the valve 466. Differential pressure sensor 34 is coupled on one end to the sense probe line in gas exchange manifold 450, and on the other end to the chamber 14 by probe sense line 35. The differential pressure sensor 34 may be a differential pressure transducer. In an alternate embodiment, two absolute pressure gauges may be used in place of the differential pressure sensor 34. In this embodiment, one gauge measures the pressure in the chamber and the other measures pressure in the container. The readings between the two gauges are then compared and the difference calculated to arrive at the differential pressure.

Gas fill line 33 couples the gas supply 24 to the gas exchange manifold 450, and gas from the supply 24 is then ported to the gas exchange head 50 via the vac/fill line 37. Vac/fill line 37 also couples the vacuum pump 22 to the flow probe 52 via manifold 450 when the apparatus is in vacuum mode. In a preferred embodiment, two redundant high pressure gas supply tanks are utilized as the gas supply 24. One tank is used at a time, and when the pressure in a first tank drops below a predetermined level, the tank usage is disabled and the second reserve tank with acceptable pressure is enabled. When the first tank is replaced or replenished, it then becomes available for switch over when the pressure in the second tank falls below the predetermined limit.

Turning now to controls for the vacuum chamber 14 as illustrated in FIG. 16, a vacuum pressure sensor 36 and fill pressure sensor 39 are coupled to the chamber 14 to measure pressure therein. The vacuum pressure sensor 36 is more sensitive at lower pressures (e.g. 0.1 atm), and the fill pressure sensor 39 is more sensitive at higher pressures (e.g. 1 atm). Three-way valve 416 is connected to the vacuum chamber 14 via connecting line 38. As will be discussed in greater detail below, a chamber orifice manifold 400 couples the 3-way valve 416 to the open atmosphere at valve 418 and to the vacuum pump 22 at valve 414. The chamber orifice manifold 400 provides for controlled evacuation and pressurization of the chamber as the container is evacuated and filled. As noted above, differential pressure sensor 34 is coupled on one end to the gas exchange manifold 450, and on the other end to the vacuum chamber 14, to thereby measure pressure differences between the head space of the container 12 and the vacuum chamber 14.

CHAMBER ORIFICE MANIFOLD

Figure 13:
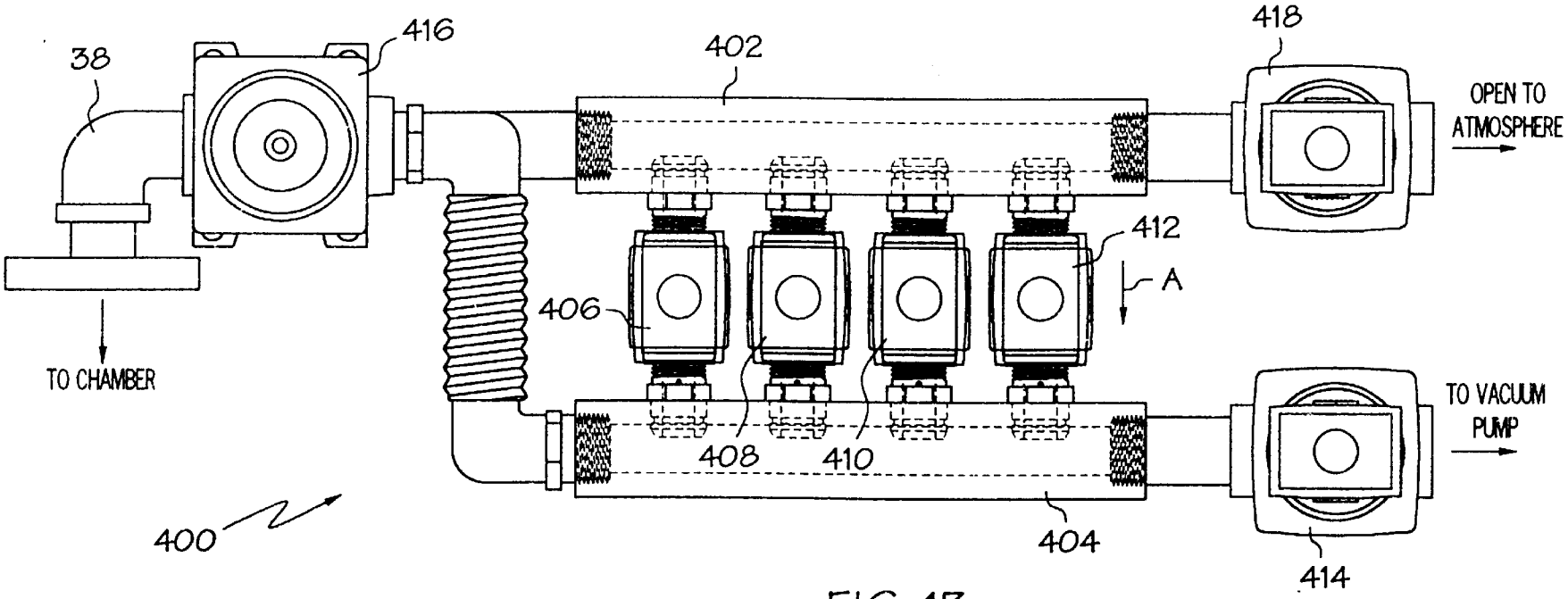
FIG. 13 is a front view of the chamber orifice manifold of the present invention.

The chamber orifice manifold 400 controls the flow of gas into and out of the vacuum chamber 14. The manifold 400 (FIG. 3) is coupled to the vacuum pump 22 on one end and to the ambient atmosphere on the other. As shown in FIG. 13, the chamber orifice manifold, generally designated 400, includes a valve in-flow pipe 402, an opposed valve out-flow pipe 404, and a plurality of valves 406, 408, 410 and 412 connecting the valve out-flow pipe 404 to the valve in-flow pipe 402. The valves 406, 408, 410 and 412 are individually controllable, one-way flow valves. The valve out-flow pipe 404 is connected on one end to the 2-way valve 414, and on its other end to the 3-way valve 416. Valve 414 is connected to the vacuum pump 22. Valve in-flow pipe 402 is connected on one end to the exhaust valve 418, and on its other end to the 3-way valve 416. Exhaust valve 418 is opened to the ambient atmosphere.

In a preferred embodiment, the valves 406, 408, 410 and 412 are binary weighted in their cross-sectional area; i.e., valve 406 as a cross-sectional area of one unit, 408 has a cross-sectional area of two units, valve 410 of four units, and 412 of eight units. This arrangement allows for increments of total area of the manifold, in integers, ranging from 0 to 15 units. The binary valve arrangement provides the ability to obtain known values for the total chamber orifice cross-sectional area without feedback verification. The chamber orifice area may be controlled simply by turning on or off various combinations of the valves. In a further preferred embodiment, the valves 406, 408, 410 and 412 are one-way valves, allowing flow direction as shown by the arrow A. With reference to FIGS. 13 and 16, when the chamber orifice manifold is set to vacuum settings, the exhaust valve 418 is off, the 3-way valve 416 is opened to the valve in-flow pipe 402, and the vacuum pump valve 414 is opened to the vacuum pump 22. With these valve settings, air is pulled from the chamber 14 through pipe 402, valves 406, 408, 410, 412, and through pipe 404 to pump 22. In contrast, when the chamber orifice manifold is switched to fill settings, the valve 414 is closed, exhaust valve 418 is opened, and the 3-way valve 416 is opened to the valve out-flow pipe 404. With these settings air is flowed into the chamber 14 through pipe 402 and valves 406, 408, 410, 412, through pipe 404 into line 38. This arrangement allows the flow path through the binary control valves to always be directed in a direction favorable to the valves' sealing capacity. This provides a reliable manifold without use of more expensive bidirectional valves. Each of the valves preferably has an O-ring sealed orifice fitting to allow for rapid assembly of the parallel manifold valves.

GAS EXCHANGE MANIFOLD

Figure 14:
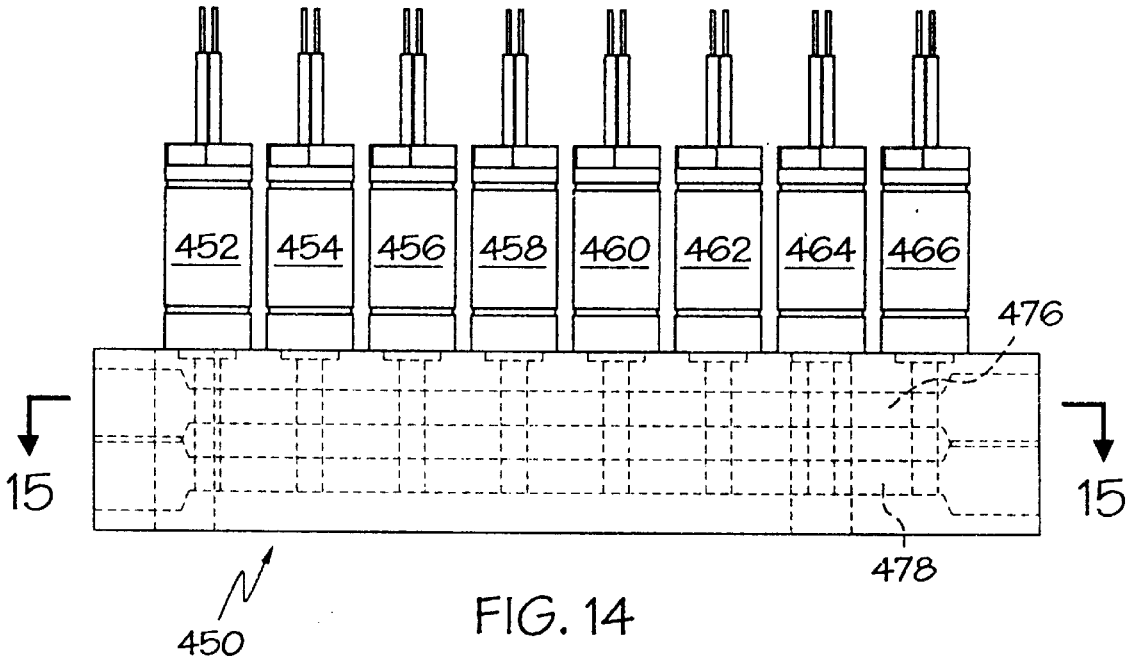
FIG. 14 is a side view of the gas exchange manifold of the present invention.
Figure 15:
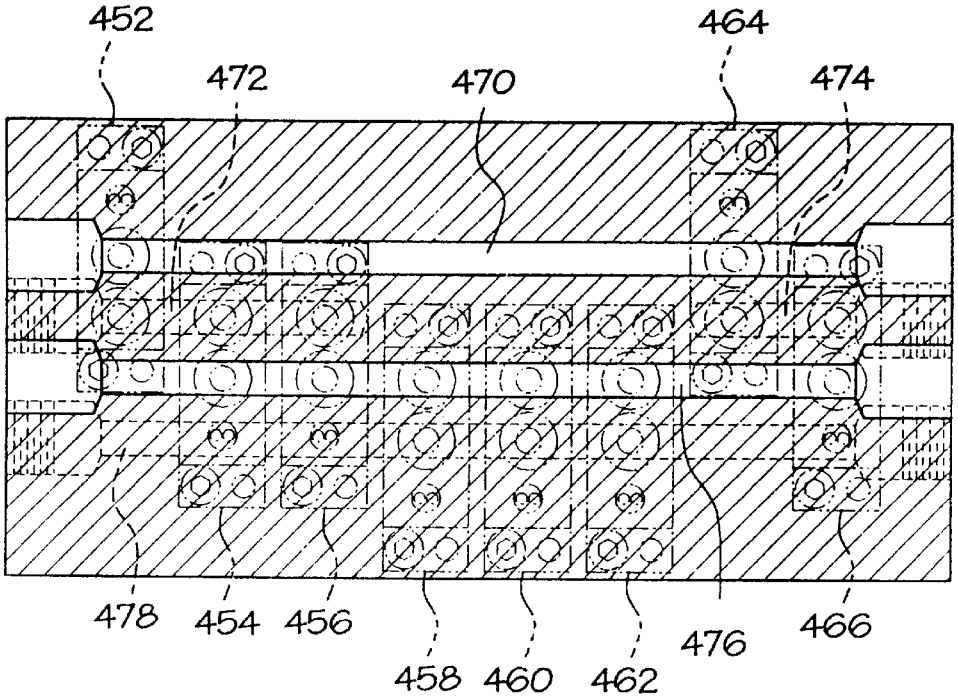
FIG. 15 is a cross-sectional view of the gas exchange manifold of FIG. 14 taken along the line 15—15.

As shown in FIGS. 14–15, a gas exchange manifold 450 is utilized to control the fill and vacuum of the container. As illustrated in FIG. 16, the gas exchange manifold 450 also ports the differential pressure sensor 34 to the gas exchange head 50. The manifold also connect the sense probe 54 to the gas supply 24, and enables the flow probe 52 and sense probe 54 to be vented to atmosphere. The gas exchange manifold 450 provides internal porting to consolidate flow paths and minimize tubing and connectors.

A set of pulse width modulated valves 452, 454, 456, 458, 460, 462, 464 and 466 control the various flows through the manifold 450. A set of five flow lines 470, 472, 474, 476 and 478 port the flows through the manifold. Flow line 470 is ported on one end to the differential pressure sensor 34 and on the other end to the sense probe 54. Flow line 472 is connected to the gas supply 24. Flow line 474 is vented to atmosphere. Flow line 476 is blocked on its one end and ported to the flow probe 52 on its other end. Flow line 478 is blocked on one end and ported to the vacuum supply 22 on its other end.

As shown in FIG. 15, valve 452 couples line 474 to line 472, and thereby allowing gas from the gas supply to be passed through the pressure probe 54. This allows the probe 54 to be "flushed" with pressurized gas to remove any debris or sanitizing fluid that may be in the probe 54. Valves 454 and 456 are both termed PWM Fill Valves, and couple line 472 to line 476. These valves thereby connect the gas supply 24 to the fill probe 52. Thus, during the filling of the container, the valves 454 and 456 are turned off and on during a 50 ms period, as will be discussed in greater detail below, to fill the head space of the container with gas from the gas supply 24. Plow probe 52 is flushed by PWM fill valve 454 and 456. Valves 458, 460, and 462 are termed the PWM Vac Valves. The PWM Vac Valves couple line 476 to line 478, thereby coupling the vacuum supply 22 to the flow probe 52. In a manner similar to the PWM Fill Valves, the PWM Vac Valves control the vacuum from the container during evacuation of the container head space. Valve 464 couples line 470 to line 474, thereby allowing the sense probe 54 to be vented to atmosphere. Valve 466 couples line 476 to line 474, thereby allowing the flow probe 52 to be vented to atmosphere.

The gas exchange manifold 450 permits fine flow regulation into and out of the container during the gas exchange process. An interface board (not shown) permits connection and disconnection of the valves at the gas exchange manifold for easy assembly and service. A single ribbon cable may be used for easy connection of the valves to the interface board. In an alternate embodiment the gas exchange manifold may be an integral part of the gas exchange head.

SANITIZING STATION

Figure 11:
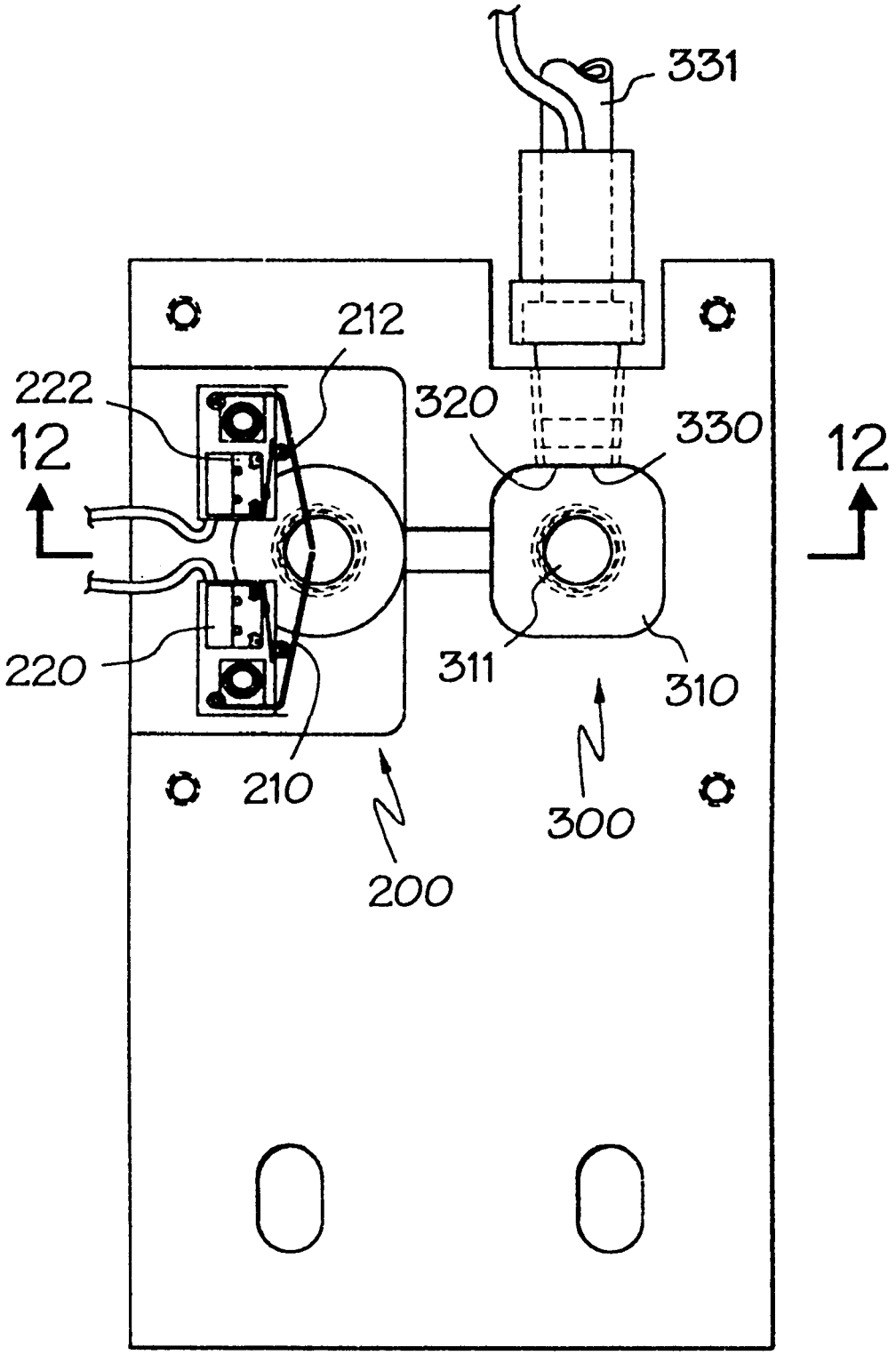
FIG. 11 is a top view of the probe sanitizing station and probe check station of the present invention.
Figure 12:
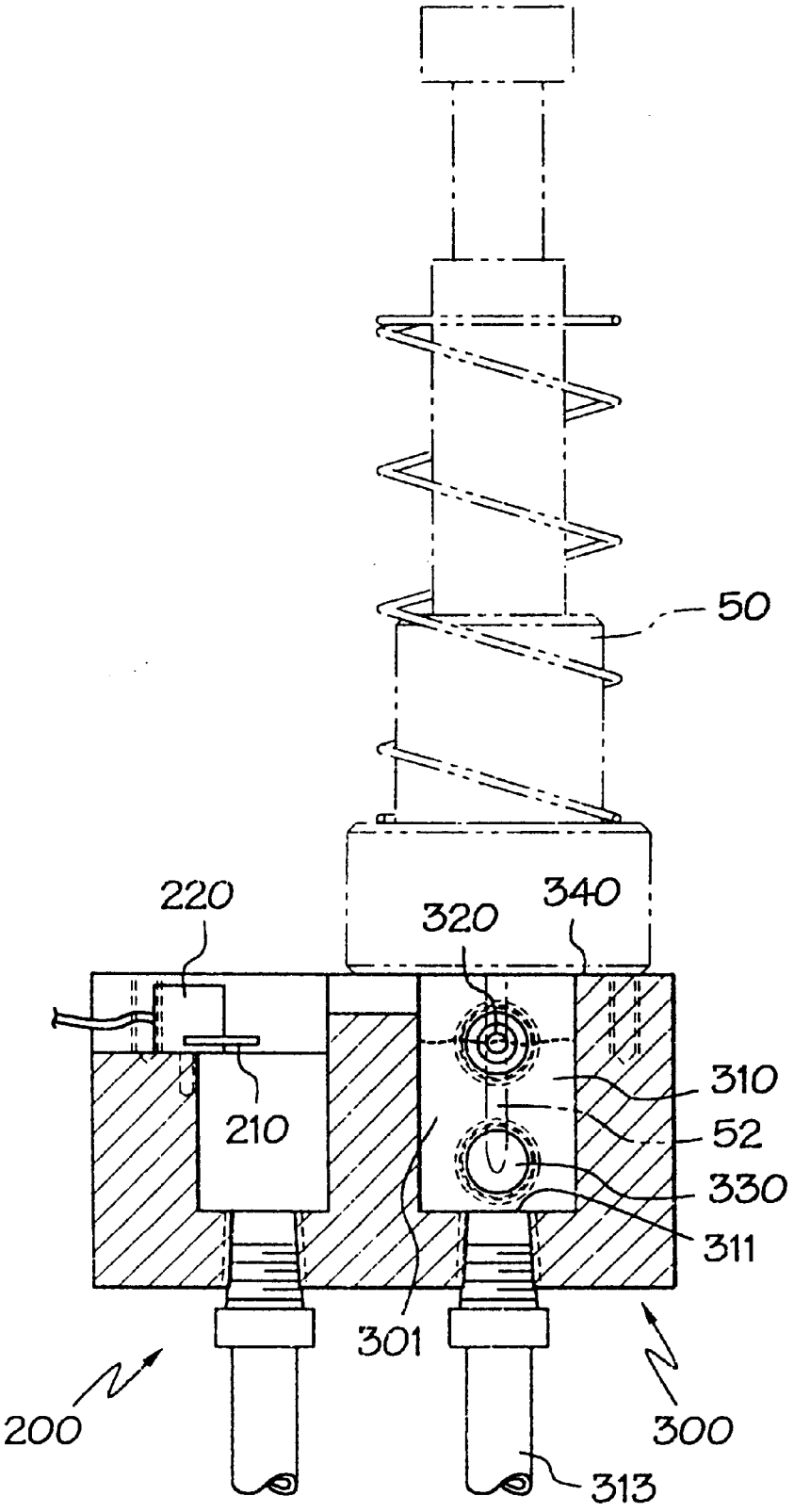
FIG. 12 is a cross-sectional view taken along the line 12—12 of FIG. 11, shown with the gas exchange head located in the sanitizing station.

As shown best in FIGS. 11 and 12, the present invention also includes a probe sanitizing station 300. When the gas exchange head 50 is not in use, the outer cylinder 60 rests on the outer cylinder rest 340 which surrounds the sanitizing solution reservoir 310, thus allowing the flow probe 52 and the sense probe 54 to be submerged in the sanitizing solution in the reservoir 310. When the gas exchange head is at the sanitizing station, the probes 52, 54 are vented to atmosphere so that the sanitizing solution can enter the probes 52, 54. The reservoir 310 is supplied with solution by gravity feed from a sanitizing solution storage container (not shown) located above the reservoir and coupled to the reservoir 310 through a fluid entry orifice 330 by tubing 331 which runs through a fill valve (not shown). The reservoir 310 is also equipped with a drain 31 1 which is coupled to tubing 313. The tubing 313 runs through a drain valve (not shown) and into a sanitizing solution waste container (not shown) located below the reservoir. In a preferred embodiment, the tubing is made of silicone, the valves are "pinch" type valves, and the sanitizing solution is a 3% hydrogen peroxide solution. At a pre-specified time interval, the drain valve may be periodically opened to allow the used sanitizing solution to flow to the sanitizing solution waste container. When this operation is completed, the drain valve is closed and the fill valve is opened to allow replacement sanitizing solution to sufficiently fill the sanitizing solution reservoir 310. Preferably, the reservoir contains a high level sensor 320 which is in communication with the valves such that a proper level of sanitizing solution is maintained.

CHECK STATION

As best shown in FIGS. 11 and 12, the present invention is also equipped with a check station 200 to confirm the integrity of the flow probe 52 and sense probe 54. The check station 200 consists of two fingers 210, 212 coupled to a pair of corresponding micro switches 220, 222. After each gas exchange operation, and before returning to the sanitizing station 300, the gas exchange head 50 is lowered to a position such that the flow probe 52 and sense probe 54 are substantially aligned with the micro switch fingers 210, 212. The gas exchange head 50 is then moved laterally back towards the switches such that the flow probe 52 and sense probe 54 contact the fingers 210, 212 respectively, thus activating the corresponding micro switches 220, 222, and confirming the integrity of the probes. If either micro switch 220, 222 is not activated after the gas exchange head has moved a certain distance, a signal is sent alerting the operator of the defective component.

SEAL PICKUP STATION

Figure 7:
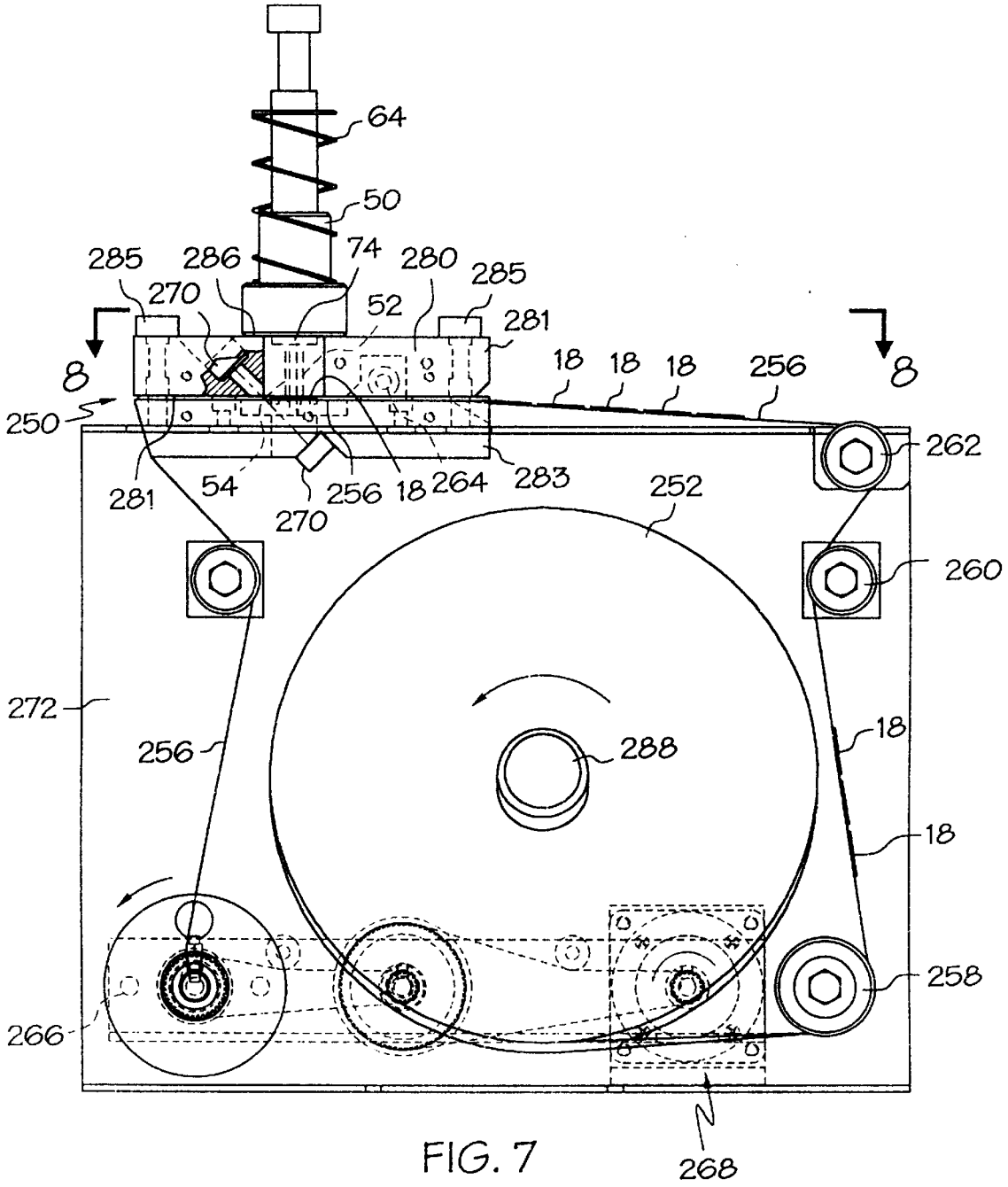
FIG. 7 is a front view of the seal pickup station of the present invention.
Figure 8:
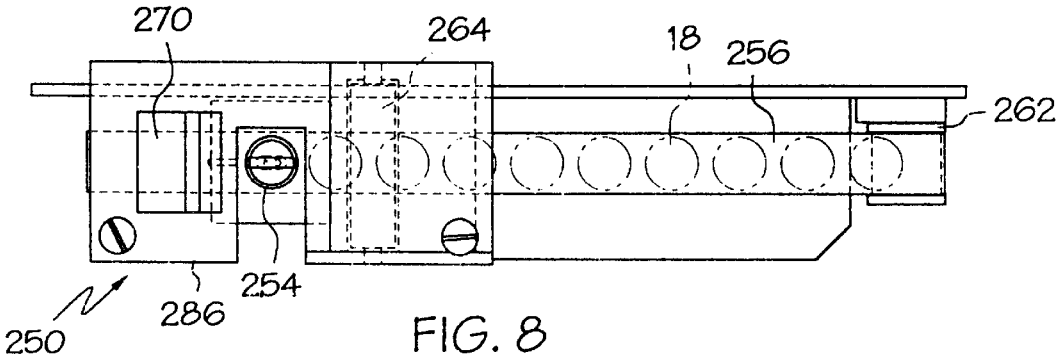
FIG. 8 is a top view of the seal pickup station of FIG. 7.

The gas exchange head 50 moves from the sanitizing station 300 to the probe check station 200, then to the seal pickup station 250, to the aperture 16 in the chamber 14, and finally back to the sanitizing station 300. Before carrying out the gas exchange, the gas exchange head 50 picks up a seal 18 from the seal pickup station 250, shown in FIGS. 7–8. The gas exchange head 50 is first moved into position over the seal pickup station 250. Linear actuator 500 then lowers the gas exchange head 50 such that the outer cylinder 60 is retained on shoulder 286 (thereby compressing the spring 64) as the intermediate sleeve 56 is lowered. In this manner, the seal pickup plate 74, flow probe 52 and sense probe 54 are exposed (FIG. 7). Valve 30 (FIG. 16) is opened to draw a vacuum in cavity 73 (FIG. 9) and through the pickup plate 74 by means of the vacuum through holes 78 (FIG. 10). Pickup plate 74 contacts a seal 18 supplied on a carrier sheet from a seal supply roll 252 (FIG. 7). The probes are passed through the seal 18 until the pickup plate 74 contacts the seal 18. The vacuum on the recessed faces 76 aids the pickup plate 74 in separating the seal 18 from the carrier or backing roll 256. Additionally, the perimeter ring 80 in the pickup plate 74 interacts with groove 254 (FIG. 8) at the seal pickup station 250 to mechanically bend the seal 18 and thereby assist in separating the seal from the carrier sheet 256.

The gas exchange head may be controlled to lower the pickup plate to contact the seal twice or more in rapid succession; i.e. "double hit" the seal. This aids in pickup of the seal by the pickup plate. Additionally, the pickup plate may reside on the seal for a predetermined "dwell" time which allows for easier separation of the seal from the seal backing roll 256. Various combinations of one or more hits by the seal pickup plate on the seal, when combined with one or more dwell times of various lengths, may be used without departing from the scope of the present invention. In a preferred embodiment, two "hits" are used, and a predetermined dwell time is used between the hits with vacuum being on during both hits.

As shown in FIG. 7 the seal pickup station 250 includes a seal supply roll 252 providing a roll of seals 18 adhesively applied to a carrier 256. The carrier 256 passes through a series of guide rollers 258, 260, 262 and then passes through the pickup block 280 through channel 281. A pressure roller 264 provides tension to the carrier sheet 256 to hold it taut as the seals 18 are lifted off. The pressure roller 264 also helps to provide tensioning at the tail end of the roll so that more of the roll may be used.

A take-up reel 266 collects the carrier sheet 256 once the seals have been removed. The take-up reel 266 is powered by a stepper motor 268. When a seal 18 is removed by the gas exchange head 50, the roll 252 is advanced until the next seal is detected in the pickup block 280. In a preferred embodiment, the stepper motor 268 may be geared down to allow for fine resolution of linear travel that is required due to the varying radius of the take up roll 266. This helps to more easily locate the seal 18 for the pickup.

The pick-up station 252 utilizes an optical emitter/detector pair 270 mounted within the pickup block 280 to sense the front edge of a seal 18. When a seal 18 is not detected, emitter/detector 270 triggers the stepper motor 268 to advance the take up reel 266 and roll 252. The emitter/detector is positioned at an angle to ensure that the sensing device is clear of the flow probe 52 and sense probe 54. The backing plate 272 for the seal supply roll 252 can be pitched rearwardly slightly with respect to a vertical plane (see FIG. 3), to allow the operator to load the supply roll 252 without employing mechanical means for holding the supply roll on the spindle 288. The spindle includes a reel tensioning means and is sized so as to form a friction fit with the center of the supply roll 252. Tensioning in the spindle provides tension on the supply roll 252 to keep it taut and prevent the supply from buckling during pickup by the gas exchange head 50. An alternate embodiment would permit movement of the senior pair relative the fixed base to allow for calibration of the seal location without moving the entire assembly.

The pickup block 280 includes an upper portion 281 and a lower portion 283 (FIG. 7). The upper portion 281 and lower portion 283 are coupled together by a pair of threaded fasteners 285. If it is desired to gain access to the center of the block 280, to correct a jam of seals 18 or the seal backing 256, the threaded fasteners 285 may be loosened to uncouple the upper portion 281 from the lower portion 283. The upper portion 281 is attached to the lower portion 283 by a hinge (not shown), thereby allowing the upper portion to be swing upwardly to provide access.

Relatively large force is required for the flow probe 52 and sense probe 54 to pierce the gum rubber seals 18. Additionally, the adhesive on the seals 18 may build up on the flow probe 52 and sense probe 54, thereby further inhibiting piercing. Thus, high withdrawal forces may be required to withdraw the flow probe and sense probe 54, which may cause the seal to be removed from the container 12 as the probes are being withdrawn. It has been found that lubrication of the seal and/or flow probe and sense probe may reduce the required piercing and withdrawal forces to counter these problems. For example, talc may be added to the gum rubber mixture of the seal as it is molded. The talc acts so as to lubricate the probes as they pierce and withdraw from the seal. Additionally, a talc coating on the surface of the seal, or a thin film of food grade grease, may be applied to either the seal or the probes to allow for easier piercing.

The sanitizing solution is also useful as a seal lubricant. For example, in a preferred embodiment the probes are kept in a three percent hydrogen peroxide sanitizing solution when the apparatus is idle. When a machine cycle is initiated, the probes are removed from the sanitizing solution and excess fluid removed. However, a small amount of solution may be left on the probes which eases insertion and withdrawal, and also avoids a buildup of adhesive on the probes. The effectiveness of other liquids, such as water, is comparable to the hydrogen peroxide sanitizing solution.

CHAMBER SWITCHES

Figure 6:
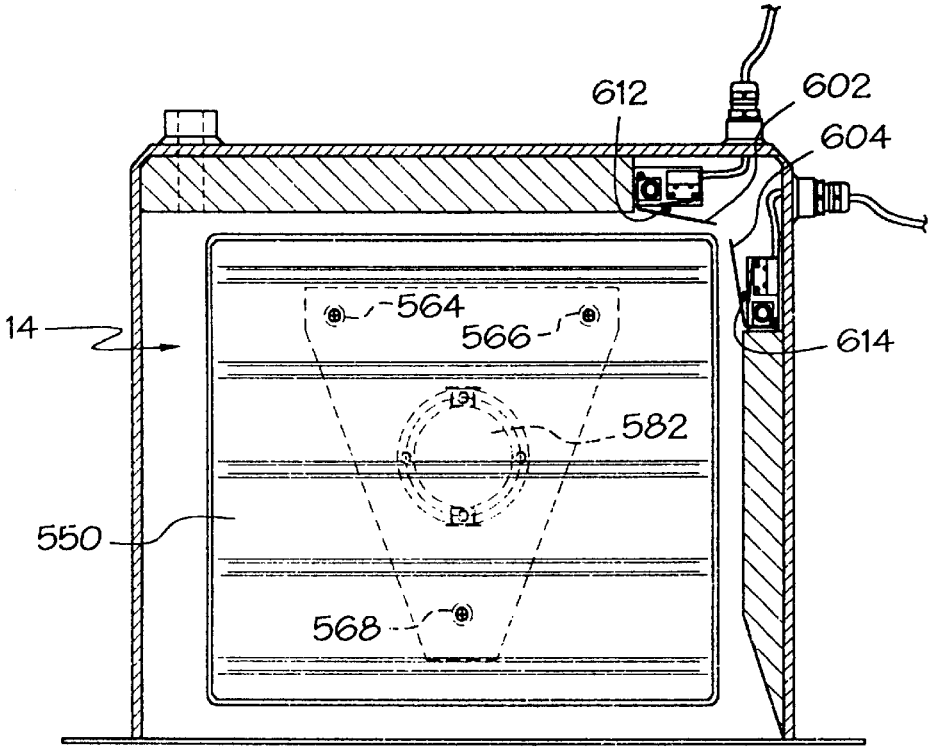
FIG. 6 is a cross-sectional view taken along the line 6—6 of FIG. 2.

As mentioned earlier, the chamber 14 is equipped with a pair of switches 602, 604 to confirm the proper orientation of the container 12 on the platform 550, shown best in FIG. 6. In the present embodiment, the switches 602, 604 are situated in the right rear corner of the chamber 14 and are held in an open position by springs 612, 614. When the operator positions the container 12 properly on the platform 550 in the chamber 14, the edges of the container 12 overcome the biasing forces of the springs 612, 614 to activate the switches 602, 604.

ELEVATOR ASSEMBLY

In order to accommodate containers of different heights, an elevator assembly 560 is employed to adjust the container 12 to the proper elevation for the gas exchange operation. As best shown in FIG. 2, the elevator assembly 560 consists of a linear actuator 562 which is mounted to the bottom of the chamber 14. The linear actuator is coupled to a central rod 582 which extends downwardly therefrom. Preferably the linear actuator 562 employs a ball screw and a DC (brush) motor and shaft encoder. The central rod 582 is attached to a lift plate 580. The elevator assembly 560 also includes three guide posts 564, 566, 568, that are attached on one end to the lift plate 580, and on the other end to the platform 550 in the chamber. Each guide post has a corresponding guide bearing 574, 576, 578 to facilitate linear motion of the platform. In addition, the guide posts 564, 566, 568 are equipped with gaskets (not shown) and the guide bearings 574, 576, 578 are equipped with seals (not shown) to prevent leaks during the vacuum and fill process.

The lower ends of the guide posts 564, 566, 568 are mounted on the lift plate 580 which is coupled to the central rod 582. After the switches 602, 604 are activated by placing a container in the chamber in proper orientation, the linear actuator 562 begins moving the central rod 582, and thus the lift plate 580, upward. This, in turn, elevates the platform 550. The chamber 14 is also equipped with a sensor 608 which is in communication with the linear actuator 562 to detect when the container 12 is raised to a proper height for the gas exchange operation. When the top edge of the container 12 is detected by the sensor 608, the linear actuator 562 continues to move the central rod 582 upward a fixed distance controlled by a shaft encoder (not shown) which locates the top of the container about a quarter of an inch from the top of the chamber 14. Elevator travel is limited as defined by the limit switches 584, 586. The lower limit is the home position for the platform 550. The upper limit operates so as to prevent damage to machine. In a preferred embodiment, the sensor 608 employs a light beam originating from a fiber optic source. The container 12 is then "puffed" or billowed outwardly by evacuating the chamber 14 and pierced with the flow probe 52 and sense probe 54 as described earlier. When the gas exchange operation is completed and the chamber pressure is equalized, the linear actuator 562 lowers the central rod 582 and plate 580 so that the platform is returned to its home position on the chamber floor.

DOOR ASSEMBLY

Figure 4:
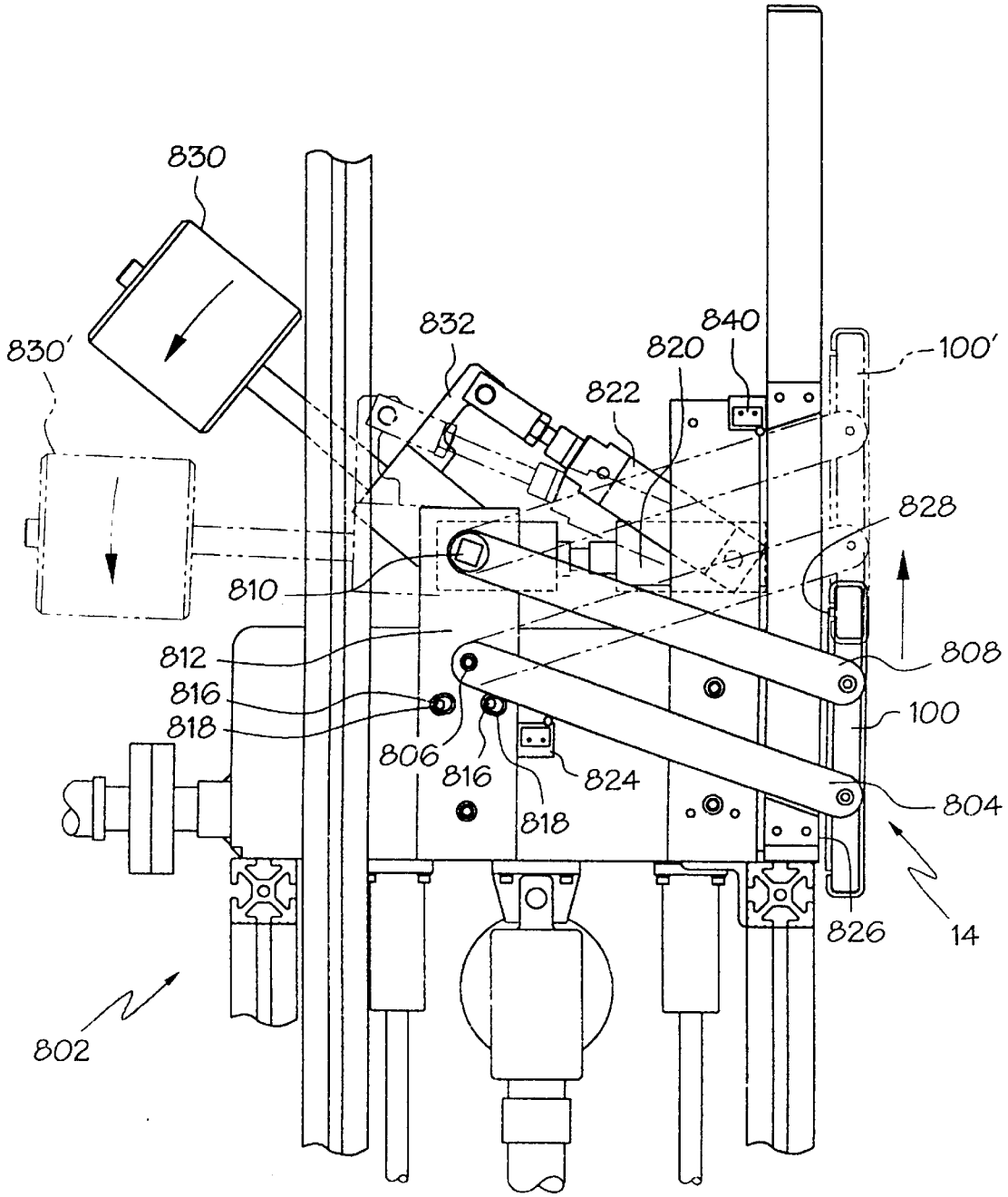
FIG. 4 is a detailed side elevation of the gas exchange apparatus of FIG. 1, with the side outer housing removed.
Figure 5:
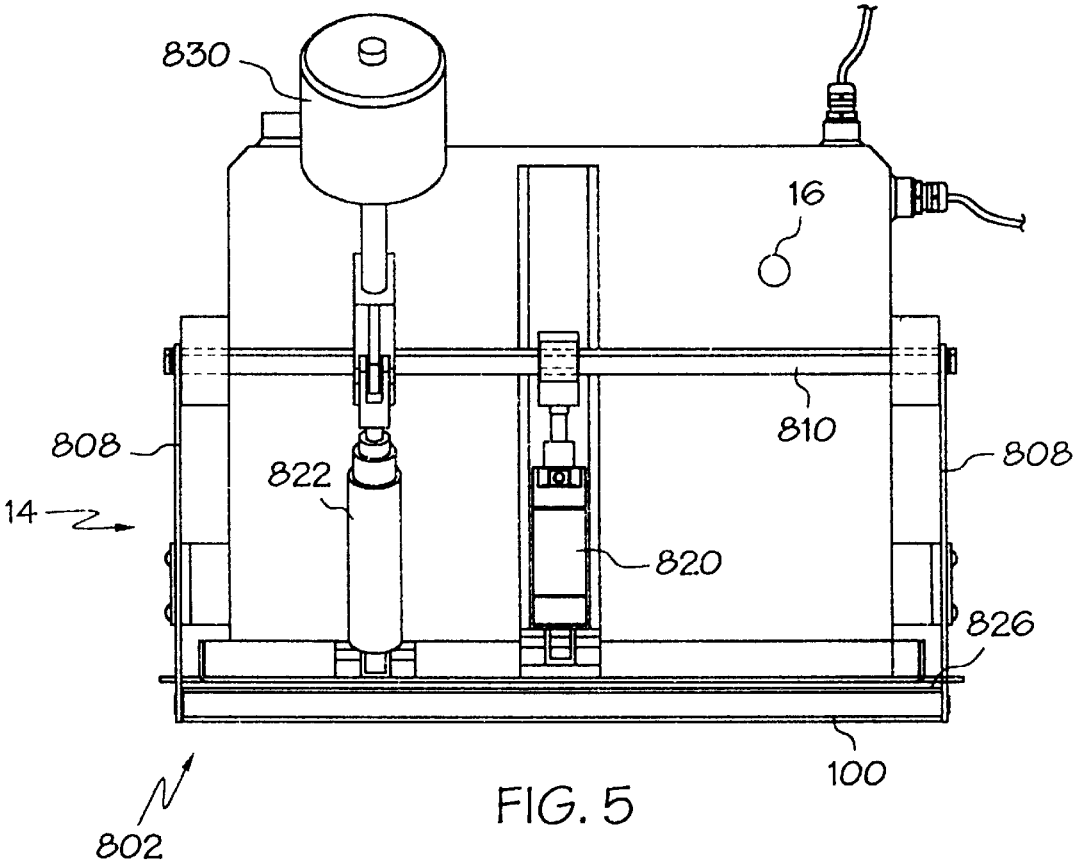
FIG. 5 is a cross-sectional view taken along the line 5—5 of FIG. 2.

The door assembly, generally designated 802, is used to raise and lower the door 100, and to effectively close the door 100 against the chamber 14 to provide an effective seal therebetween. The door 100 cover opening 801 (FIG. 2) of the chamber 14. As shown in FIGS. 4–5, the door assembly 802 includes a pair of opposed lower arms 804, each of which may pivot about pin 806. Mounted above, and parallel to, the lower arms 804 is a set of opposed upper arms 808. The upper arms 808 are connected by a bar 810 having a non-circular cross-section which couples the movement of the upper arms 808 to avoid binding of the door as it is opened and closed. Each lower arm 804 and upper arm 808 is mounted on a mounting bracket or plate 812. The mounting bracket 812 is connected to the side of the chamber 14 by a pair of mounting pins 816 each of which are received in an oval slot 818 formed in the bracket 812. This arrangement allows the mounting bracket 812 to shift slightly to the left and to the right to provide flexibility and "give" to the closure system, as will be described in greater detail below.

The door assembly 802 further includes a double acting in/out cylinder, or closure cylinder 820, as well as a single acting open cylinder 822. A linkage mechanism 832 couples the open cylinder 822 to the counterweight 830. Counterweight 830 is designed to offset the weight of the door 100, and provides the door with a neutral feel so that minimum force is required by the operator to move the door. The open cylinder 822 is coupled to the vacuum pump 22 by a flow control valve (not shown), and is also mechanically coupled to the bar 810 by the linkage mechanism 832.

Once a container 12 is placed in the chamber 14, the door 100 is manually moved to the closed position, thereby triggering switch 824. Once switch 824 is triggered, indicating that the door 100 is in the closed position, the in/out cylinder 820 contracts, thereby drawing the door 100 flush against the fascia 826 of the chamber 14. The in/out cylinder 820 helps to pre-seal the door, and when a full vacuum is drawn on the chamber 14, the door 100 is more fully sealed with respect to the chamber 14. A closed cell foam gasket 828 around the perimeter of the door is used to seal the door, and a dove-tail groove is preferably used to maintain the gasket 828 in place. When the in/out cylinder 820 pulls the door 100 inwardly, the mounting bracket 812 may pivot, as enabled by the oval slots 818, which avoids stressing the arms 804, 808. This mechanism also reduces wear of the gasket 828 during opening and closing of the door.

Once the gas exchange operation is complete, the in/out cylinder 820 is actuated, thereby urging the door 100 slightly away from the fascia 826. The mounting bracket 812 may again pivot to account for this movement. Next, the open cylinder 822, as actuated by the flow control valve, extends outwardly, thereby rotating bar 810. This moves the door 100 upwardly into the open position and the counterweight 830 downwardly (shown as counterweight 830' and door 100' in FIG. 4). In this manner, the door 100 is automatically opened at the end of the gas exchange operation. A switch 840 is triggered by an upper arm 808 to indicate when the door has reached the open position.

The opening of the door 100 serves as an indicator to the operator that the gas exchange operation is complete. The door 100 preferably includes a center portion of floating Lexan or other suitably transparent material to allow the operator to see into the chamber. Preferably, no bolts or other fasteners are passed into the Lexan, which maintains the integrity and strength of the material.

LINEAR ACTUATOR/MOTION SYSTEM

Figure 26:
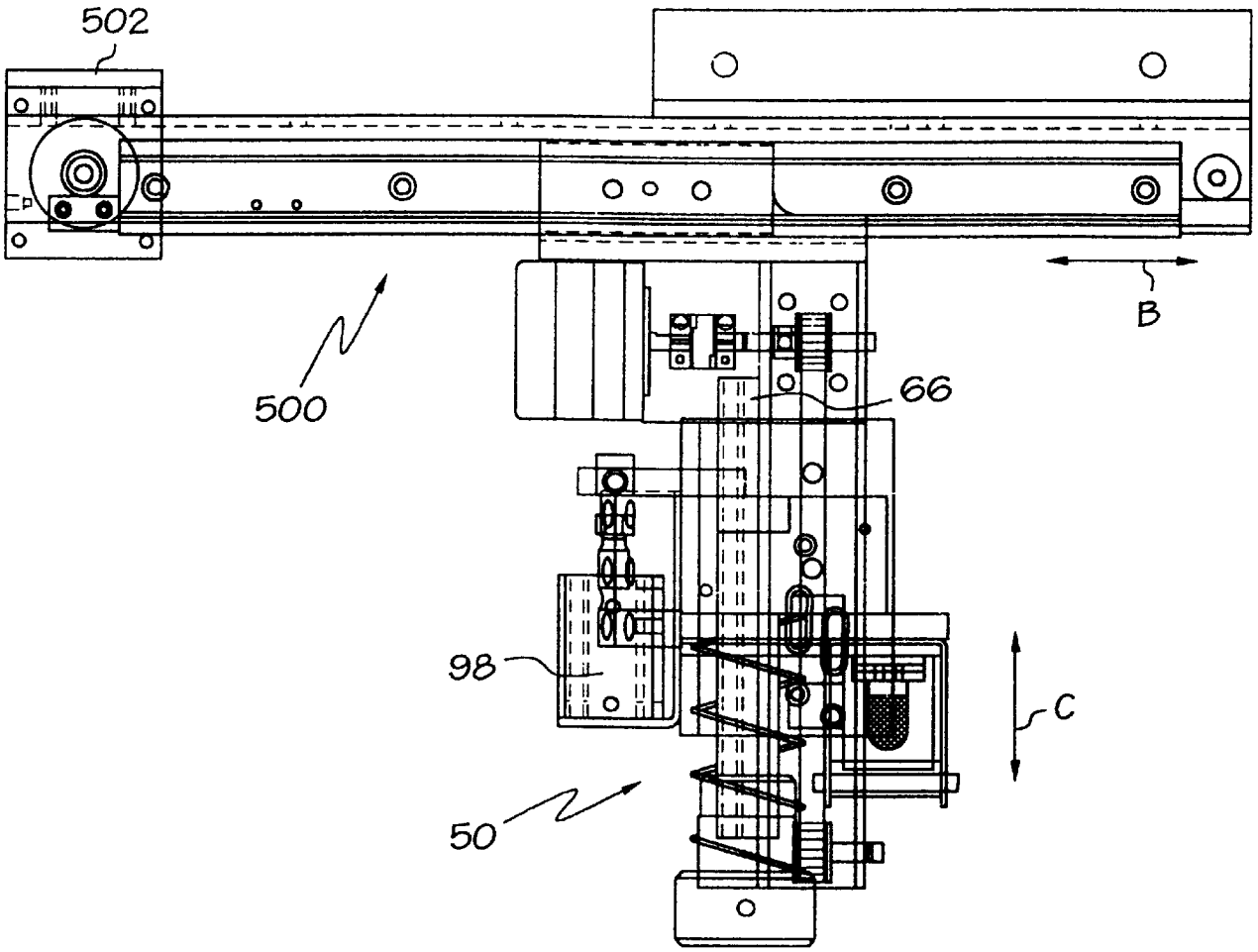
FIG. 26 is a side view of the motion system of the present invention.
Figure 27:
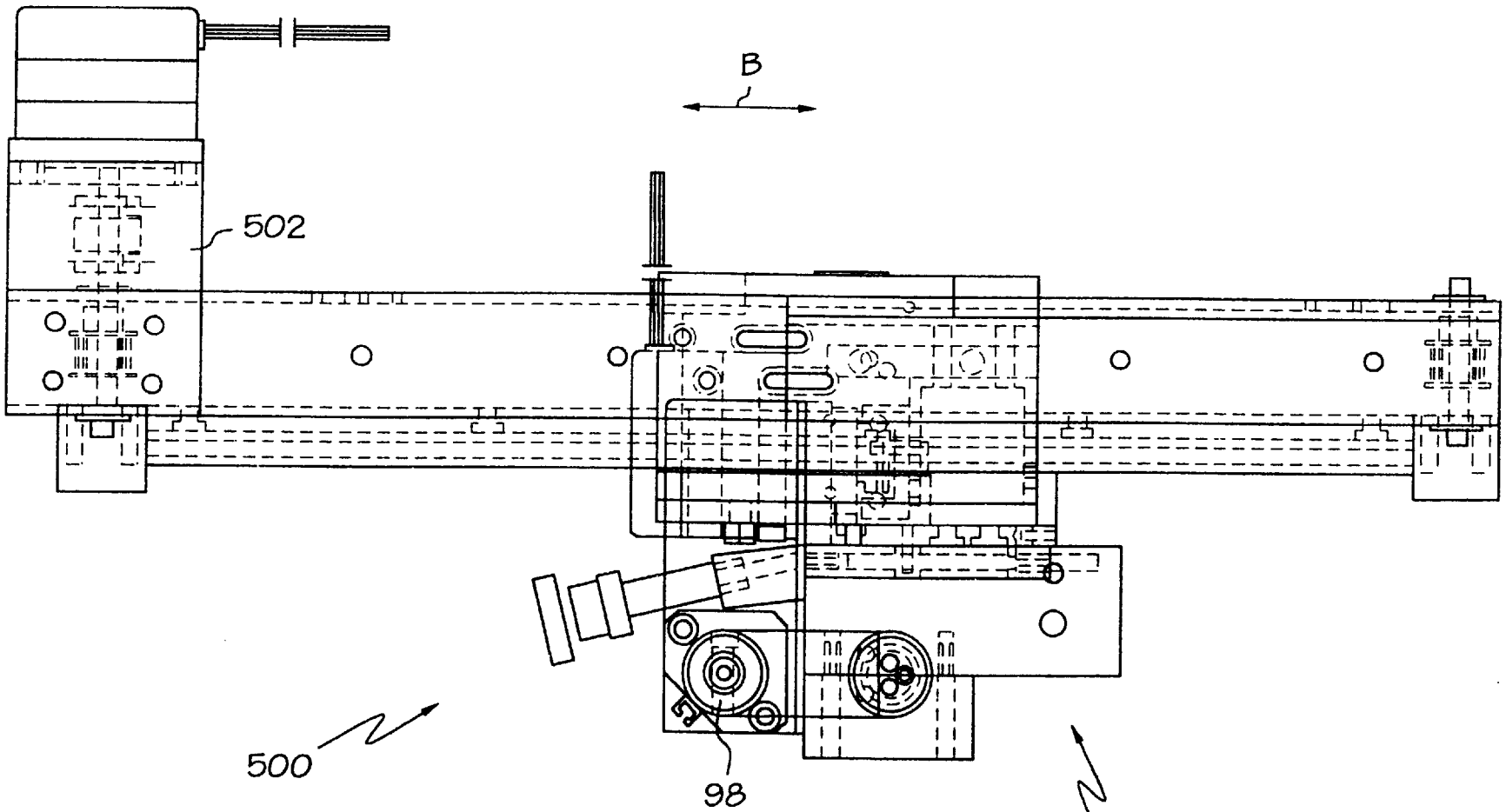
FIG. 27 is a top view of the motion system of FIG. 26.

The linear motion system, generally designated 500, as shown in FIGS. 26 and 27, moves the gas exchange head 50 from the sanitizing station 300, to the probe check station 200, to the seal pickup station 250, to the aperture 16 in the chamber 14, and finally back to the sanitizing station 300. This horizontal movement is shown by arrow B in FIG. 26. The linear motion system 500 also moves the gas exchange head vertically at the various stations to immerse the probes in sanitizing solution, lower the probes to the probe check switches, lower and raise the head to pick up a seal, and pierce the container. The vertical motion is shown by arrow C in FIG. 26.

The linear motion system uses aluminum channels for its structural body, and a linear slide system for its linear bearings. Timing belts and pulleys are used to power the system from the rotary motion of a stepper motor 502. Optical, beam-breaking sensors are mounted throughout the system allow for home and limit position sensing. The stepper motor 502 uses a toothed pulley to provide predictable linear travel relative to a known home location for a specified number of steps. Motion control software automatically calculates the motion trajectory parameters (i.e., acceleration, plateau, deceleration and jog) of the gas exchange head when it is moved from one station to another. The calculated trajectory minimizes travel time, while avoiding excessive acceleration of the gas exchange head.

CONTROL ALGORITHM

A control algorithm, which may be implemented by a microprocessor based controller, is preferably utilized to oversee, control, and adjust the gas exchange procedure. In conducting the gas exchange, the container 12 and the chamber 14 are simultaneously evacuated under controlled conditions so as not to damage the container until the pressure within the container reaches a sufficiently low predetermined level (e.g. 0.1 atm). Once the container is evacuated, a replacement gas, such as oxygen is released into the container, while atmospheric air is simultaneously released into the chamber 14 in a controlled manner. The control algorithm is preferably designed to maintain a slightly positive container-to-chamber differential pressure throughout the vacuum and fill cycles so as not to damage the container or force the lid onto the enclosed product. The algorithm is also preferably flexible enough so as to carry out the gas exchange efficiently for a wide range of container sizes, without requiring knowledge of the container characteristics. Additionally, the algorithm preferably provides for an adjustable final container appearance wherein the user is able to adjust the final pressure in the container, and thus the convexity of the container lid. A microprocessor based controller is utilized to implement the algorithm.

Two separate sets of valves control the flow of gas into and out of the chamber and the container, respectively. A set of pulse width modulated (PWM) valves housed in the manifold 450 control the gas flow into (valves 452 and 454) and out of (valves 458, 460 and 462) the package. The PWM valves operate by turning the gas flow into or out of the container on and off at a variable duty cycle. In one embodiment, the PWM control period is 50 milliseconds (ms) and is adjustable in 0.25 ms increments to provide an ontime of 5 to 45 ms within that 50 ms period. Those skilled in the art will appreciate that while these values are convenient to use, the invention is not limited to these precise values. To control gas flow in the chamber, a set of chamber orifice valves is provided. In the embodiment illustrated herein, the chamber orifice valves are a plurality of individually actuable one-way control valves connected in parallel. The chamber orifice valves are preferably binary weighted to provide for an incremental spectrum of control. In the embodiment illustrated herein, the chamber orifice valves are adjustable from a setting of a minimum of 0 to a maximum of 15. In the illustrated embodiment, valves 406, 408, 410, 412 have respective orifice cross-sectional areas in a ratio of 1:2:4:8. By opening and closing a combination of these valves, flow settings through a total area of 0 to 15 can be obtained, as discussed below in greater detail.

Although the invention is described herein as using PWM and/or one-way binary-weighted valves, it is to be understood that it is within the scope of the present invention to include any type of valves which can control the flow into or out of the containers or chamber. Additionally, the algorithm described herein incorporates a plurality of machine and valve parameters, pump rates, and valve sizes, as well as a plurality of user-defined pressure settings, dimensions, and the like. It is to be understood that the specific parameters included herein are for illustrative purposes only, and the invention is not limited to these precise forms or parameters.

The term head space volume, or simply head space, is used herein to represent the capacity of the container to receive a gas; that is, the volume not occupied by the product contained in the container. In a preferred embodiment of the algorithm, as a preliminary step to carrying out the complete gas exchange, it is determined whether the container has a relatively large or relatively small head space volume. Either a large container gas exchange control algorithm or a small container gas exchange control algorithm is selected to control the gas exchange based upon this determination.

It is desirable to determine the size of the head space volume in order to minimize the time required to carry out the gas exchange, and to initialize the chamber orifice and PWM valve settings to desirable levels. When a small head space volume container is utilized, the vacuum and fill control cycles are "chamber limited." That is, the head space in a small head space volume container can be evacuated and filled faster than the chamber can be evacuated and filled. Thus, in order to minimize time required to carry out the gas exchange, the chamber orifice valves are typically opened to essentially their maximum controllable values when drawing gas from containers having a relatively small headspace. Minor adjustments to the PWM valves may be made to keep the chamber orifice valves at the largest controllable values. In contrast, for large head space volume containers, the vacuum and fill control cycles are "container limited", and the chamber volume can be evacuated and filled faster than the head space of the container. In this case, the PWM valves are typically opened to essentially their maximum controllable value, and the chamber orifice valves are adjusted to maintain the differential pressure when exchanging gas in a container having a large headspace. Minor adjustments may e made to the chamber valves to keep to PWM valves at the largest controllable valves.

Figure 17:
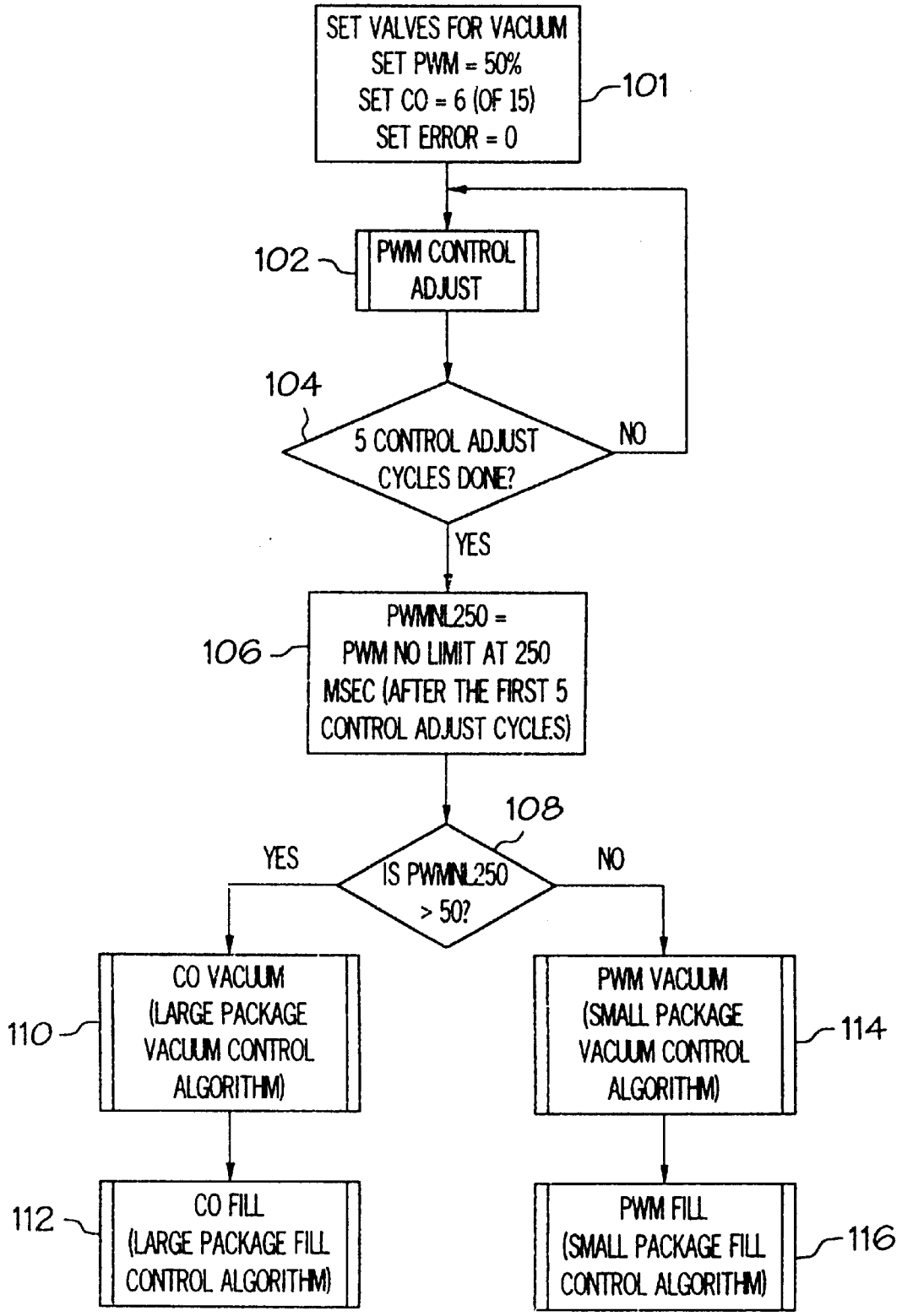
FIG. 17 is a flow chart showing the overall operation of the control algorithm of the present invention.

A preferred method of determining relative container head space volume is illustrated in FIG. 17. As shown at step 101, values for the PWM valves and the chamber orifice (CO) valves are set to initial values such as approximately 40–60% open. The gas exchange procedure is then commenced, and the PWM Control Adjust step 102 is carried out. As will be discussed in greater detail below, the PWM Control Adjust step evacuates the chamber and the container simultaneously, while maintaining a variable target pressure differential between the two systems. As shown in step 104, five Control Adjust cycles are carried out, with each control cycle being 50 ms. At each Control Adjust cycle, the PWM valve settings are adjusted to achieve and maintain the target differential pressure setting, as will be discussed in greater detail below. Once five Control Adjust cycles are carried out, the total value of the PWM valves is examined at step 106. The variable PWMNL 250 represents the value of the PWM valves after five cycles at 50 ms (a total of 250 ms). Step 108 is a decision step for determining whether the large container algorithm or small container algorithm is to be utilized. If the value of PWMNL 250 is greater than, for example, 50 (an empirically derived number for optimum performance), the large container algorithm is utilized. On the other hand, if PWMNL 250 is not greater than 50, the small container algorithm is utilized.

In this preferred method for choosing the large or small container algorithm, the chamber and container valve orifices are fixed at an initial value, and a feed back control based upon the pressure difference in the container and chamber is utilized. The value of the PWM valves after a fixed period of time is proportional to the head space of the container. This preferred method of determining head space volume maintains differential pressure in an acceptable range during period of the head space size determination. This allows more time to have a more accurate reading of the head space volume.

In an alternate method of determining container head space volume, the chamber and the container valve orifices are set to a predetermined level based upon a look-up table. Gas/air is then drawn from both the chamber and the container for a fixed time. The derivative (rate of change with time) of the differential pressure is measured. If the derivative is negative, the small headspace algorithm is used. If it is positive, the larger headspace algorithm is used. This open loop method must occur quickly so that container pressure does not exceed limits at which the container is damaged before the feed back control algorithm can be commenced.

The PWM Control Adjust step, step 102 of FIG. 17, will now be explained in greater detail. As mentioned earlier, in the preferred embodiment the goal of the control system is to maintain a slightly positive head space differential pressure. (Those skilled in the art will appreciate that there will be instances in which the materials used in the container permit the use of a negative differential, and that while the invention is preferably practiced using a positive differential pressure, it is only essential that a differential pressure which does not damage the container be used.) In the embodiment illustrated herein, the differential pressure is preferably maintained in a range between about 0.034 to 0.136 atm (0.5 to 2 psi) throughout both the vacuum and fill cycles. In both the vacuum and fill cycles, the target differential pressure begins at 0.068 atm and is gradually reduced to 0.034 atm toward the end of each cycle, with the change preferably being a linear reduction based on chamber pressure. That is, when the vacuum cycle begins, the target differential pressure setting is preferably 0.068 atm. As the pressure in the chamber is reduced, the target differential pressure is also reduced until, toward the end of the vacuum cycle, the target differential pressure is 0.034 atm. In the fill cycle, the target differential pressure preferably begins at 0.068 atm and is lowered to 0.034 atm as the pressure in the chamber increases. This method allows for more margin of error at the start of the vacuum and fill cycles, and accuracy increases towards the end of each cycle. Additionally, this method allows the target vacuum to be reached quickly. Unless it is otherwise noted, pressures are expressed in values relative to the measured atmospheric pressure during the vacuum/fill cycle, and not standard atmospheric pressure.

Figure 20:
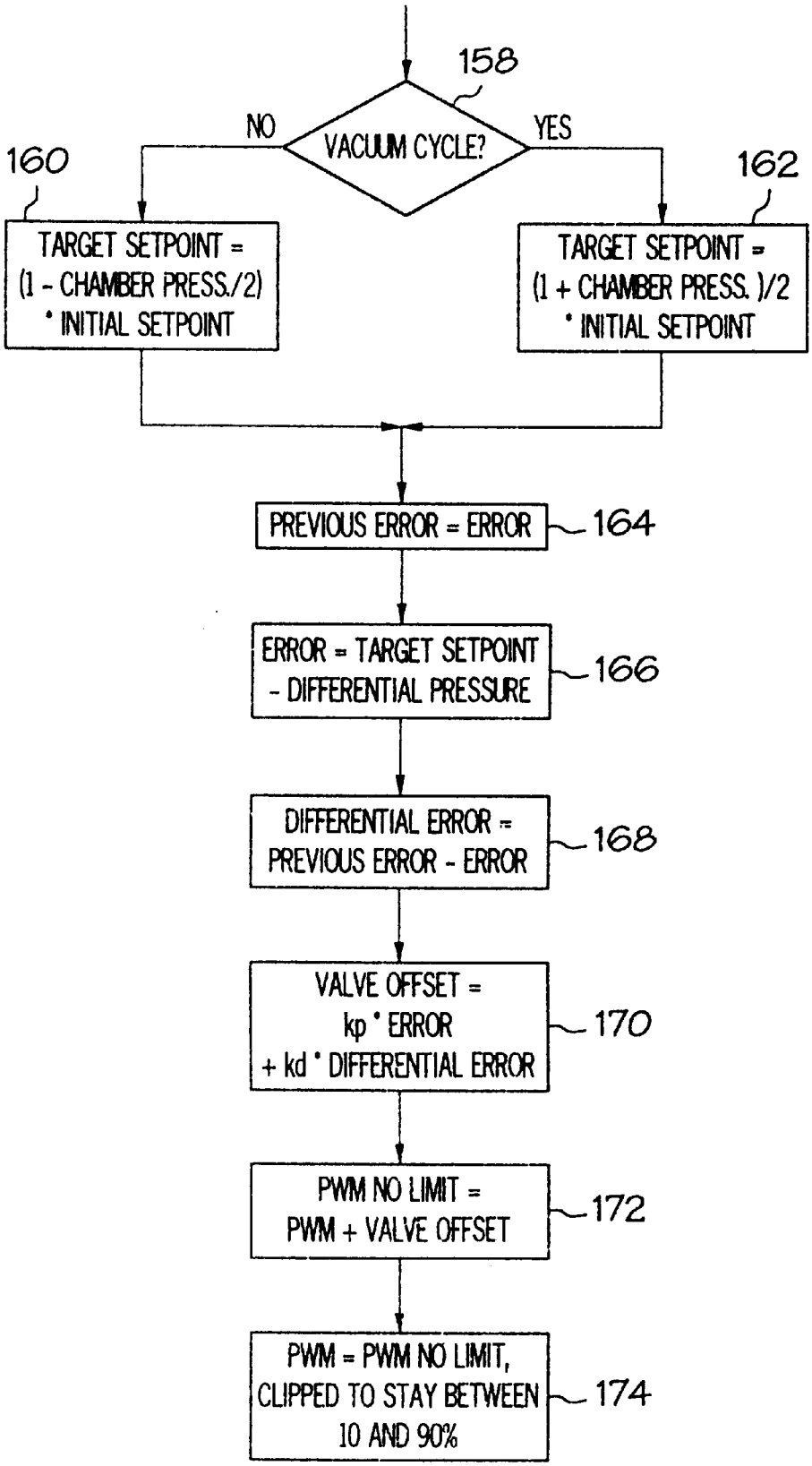
FIG. 20 is a flow chart showing the PWM control adjust algorithm of the control algorithm of the present invention.

Steps 158, 160 and 162, as shown in FIG. 20, illustrate one method that may be used to reduce the target pressure as each cycle progresses. At step 158 it is determined whether the apparatus is in a vacuum cycle or not. If in a vacuum cycle, at step 162 the target set point is reduced as the chamber pressure decreases. In contrast, in the fill cycle as at step 160, the target set point is reduced as the chamber pressure increases.

FIG. 20 illustrates the rest of the PWM Control Adjust algorithm. Steps 164, 166, 168, 170, 172 and 174 represent steps carried out to adjust the PWM valves to maintain the differential pressure close to the target set point. An error is first calculated at step 166. The error represents the difference between the target differential pressure and the measured differential pressure. At step 168 a differential error is calculated. Adding an error term based on the rate of change of error (derivative error) greatly improves transient response to reduce over shoot and under shoot of the system, especially since container characteristics may not be known. At step 170, a valve offset is calculated, which is added to the present setting of the PWM valves to adjust the valve setting. The symbols kp and kd represent empirically derived adjustment constants. These constants will be similar for the vac and fill cycles but will be the opposite sign, i.e., if they are plus in the vac cycle they are minus in the fill cycle and vice versa. Once the value offset is calculated, it is added to the PWM setting at 172. The valve offset may either increase or decrease the PWM valve setting. At step 174 the value for the PWM valve is clipped so that the valves are on for between 10% and 90% of their cycle, as this is the absolute range in which the PWM valves must be maintained.

Figure 18:
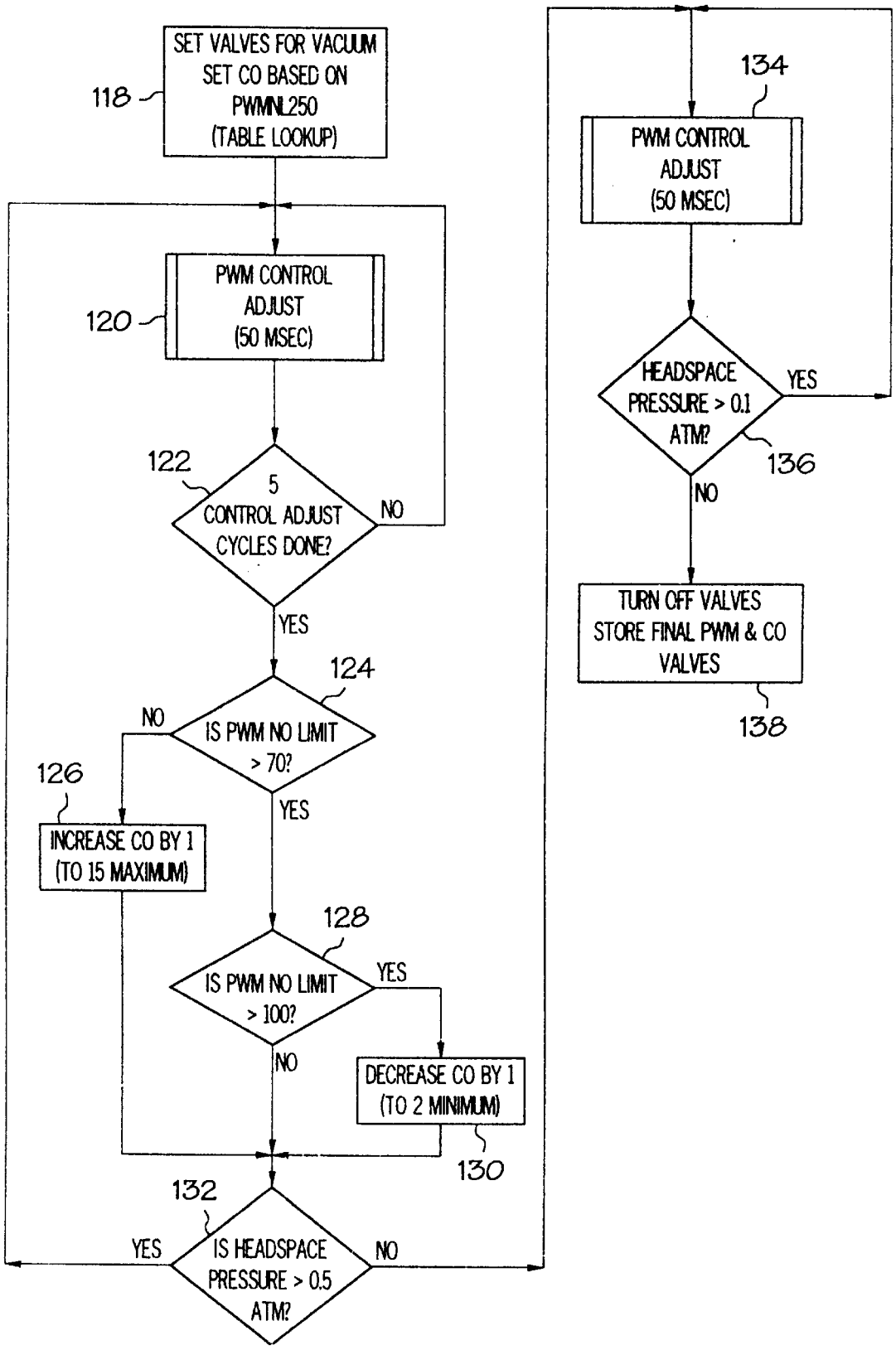
FIG. 18 is a flow chart showing the PWM vacuum algorithm of the control algorithm of the present invention.

Returning to the flowchart in FIG. 17, if the small container algorithm is selected, the chamber and container are evacuated using the PWM Vacuum Control Algorithm 114. This algorithm is fully illustrated in FIG. 18. As shown in step 118, the first step of the PWM Vacuum Algorithm is to set the chamber orifice valves, based on a table which depends upon the value of PWMNL 250. One example of such a look-up table is illustrated in FIG. 24. While the look-up table provides CO settings for PWMNL 250 values less than 50, in the preferred embodiment of the invention if the PWMNL 250 value is less than 50, the large headspace algorithm would be used instead. Next, at step 120, the PWM Control Adjust is carried out. As discussed earlier, and fully illustrated in FIG. 20, this step compares the differential pressure to the target differential pressure, and makes adjustments to the PWM valve settings accordingly. If the differential pressure is too large, the PWM valve settings are increased. If the differential pressure is too low, the PWM valve settings are decreased.

After every five Control Adjust cycles, as controlled by step 122, the value of the PWM valves is checked to insure that they are within controllable limits. As shown in step 124, it is first examined whether the non-clipped PWM value is greater than 70. If it is not, as shown in step 126, the chamber orifice valves are increased one unit to bring the PWM valves into a controllable range. If the PWM non-clipped limit is greater than 70, at step 128 the system examines whether the PWM non-clipped value is greater than 100. If it is, the chamber orifice valves are decreased one unit to bring the PWM valves in a controllable range. However, in no event is the chamber orifice opening set to less than two units to ensure a minimal vacuum flow in the chamber. This check performed at steps 128, 130 is used to adjust the chamber valve settings to keep the valve control in the optimal range if the feedback control system adjusts the PWM valves outside an optimal range. This keeps gas exchange cycle speed high while retaining control of the system.

The above described procedure continues until the head space pressure in the container drops below 0.5 atm, as controlled by step 132. If the head space pressure is less than 0.5 atm, then the PWM Control Adjust, at step 134, continues until the head space pressure is not greater than 0.1 atm, as controlled by step 136. Once the value for head space pressure drops below 0.5 atm, the chamber orifice valves are no longer adjusted. This change is made in order to retain the valves in an optimum position for initiating the fill algorithm. When the fill algorithm is started, the valves are initialized at their settings that they were opened to when the vacuum cycle ended. Thus, it is advantageous to "freeze" the chamber orifice valve settings at this point to obtain optimum performance when the fill cycle begins. Accordingly, once a headspace pressure of 0.5 atm is reached, gas is withdrawn from the container at a rate determined by the PWM control adjust algorithm until the headspace pressure is 0.1 atm or less. Once the head space pressure is not greater than 0.1 atm, the vacuum step is terminated at step 138, and the valves are turned off.

Figure 19A:
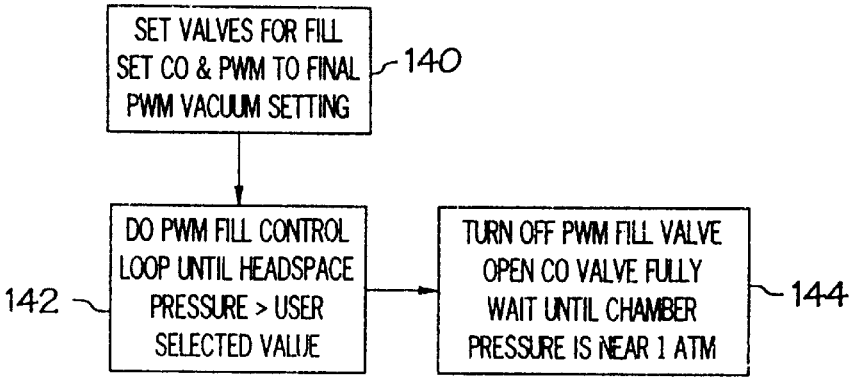
FIG. 19A is a flow chart showing the PWM fill algorithm of the control algorithm of the present invention.
Figure 19B:
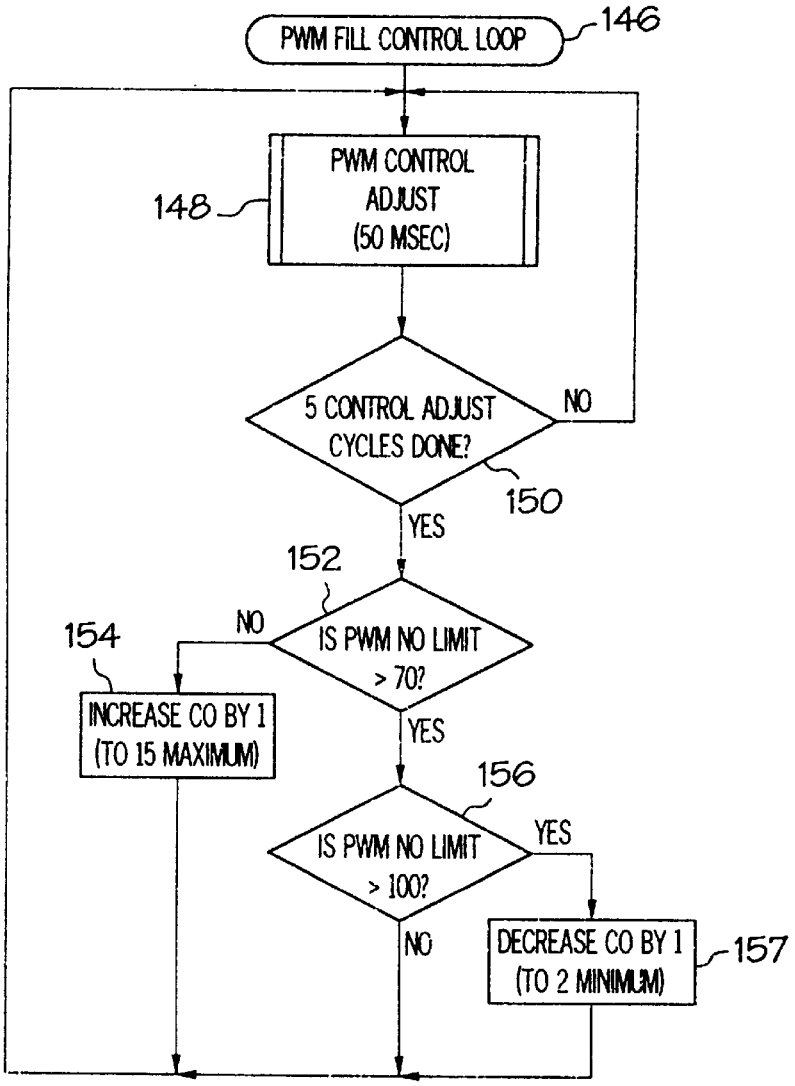
FIG. 19B is a flow chart showing the PWM fill control loop of the control algorithm of the present invention.

Returning to FIG. 17, after the PWM Vacuum Algorithm 114 is completed and the container has been effectively evacuated, the PWM Fill Algorithm 116 is carried out. The PWM Fill Algorithm is more fully shown in FIGS. 19A and 19B. As the first step of the PWM Fill Algorithm, at step 140 the chamber orifice valves and PWM valves are set to a fill setting. The chamber orifice and PWM valves are initialized at their final vacuum settings (i.e. their values when the PWM Vacuum Algorithm was halted). The PWM Fill control loop at step 142 of FIG. 19A is more fully illustrated in FIG. 19B. At step 146, the PWM Fill control loop is initiated. The PWM Control Adjust Step, as previously described, is then carried out for five cycles, as controlled by steps 148, 150. The analogous control steps as previously described for the PWM Vacuum Algorithm are utilized as steps 152, 154, 156, and 157 in the PWM Fill Algorithm to maintain the PWM valves in a controllable range.

As schematically represented in step 142 in FIG. 19A, the fill procedure continues until the head space pressure reaches a user selected value. These values are selected based on the amount of puff the user desires in the container lid. Once the container is sufficiently filled that the head space pressure criteria is met, at step 144 the valves are set to an end setting, and the system waits until the chamber pressure is nearly equalized with the ambient atmosphere before shutting down. This "end fill" value is user adjustable to allow the user to customize the end pressure desired in the container. Some users may desire a flat lid with no puffing and no pressure differential relative to atmosphere, while others may prefer a puffed lid with a slightly positive pressure in the container. In one embodiment, the package is simply filled to the desired pressure and the procedure is terminated. An alternate method is to slightly over fill the container and, after the chamber has reached atmospheric pressure, vent the container to atmosphere for a user definable time to achieve the desired appearance.

Figure 23:
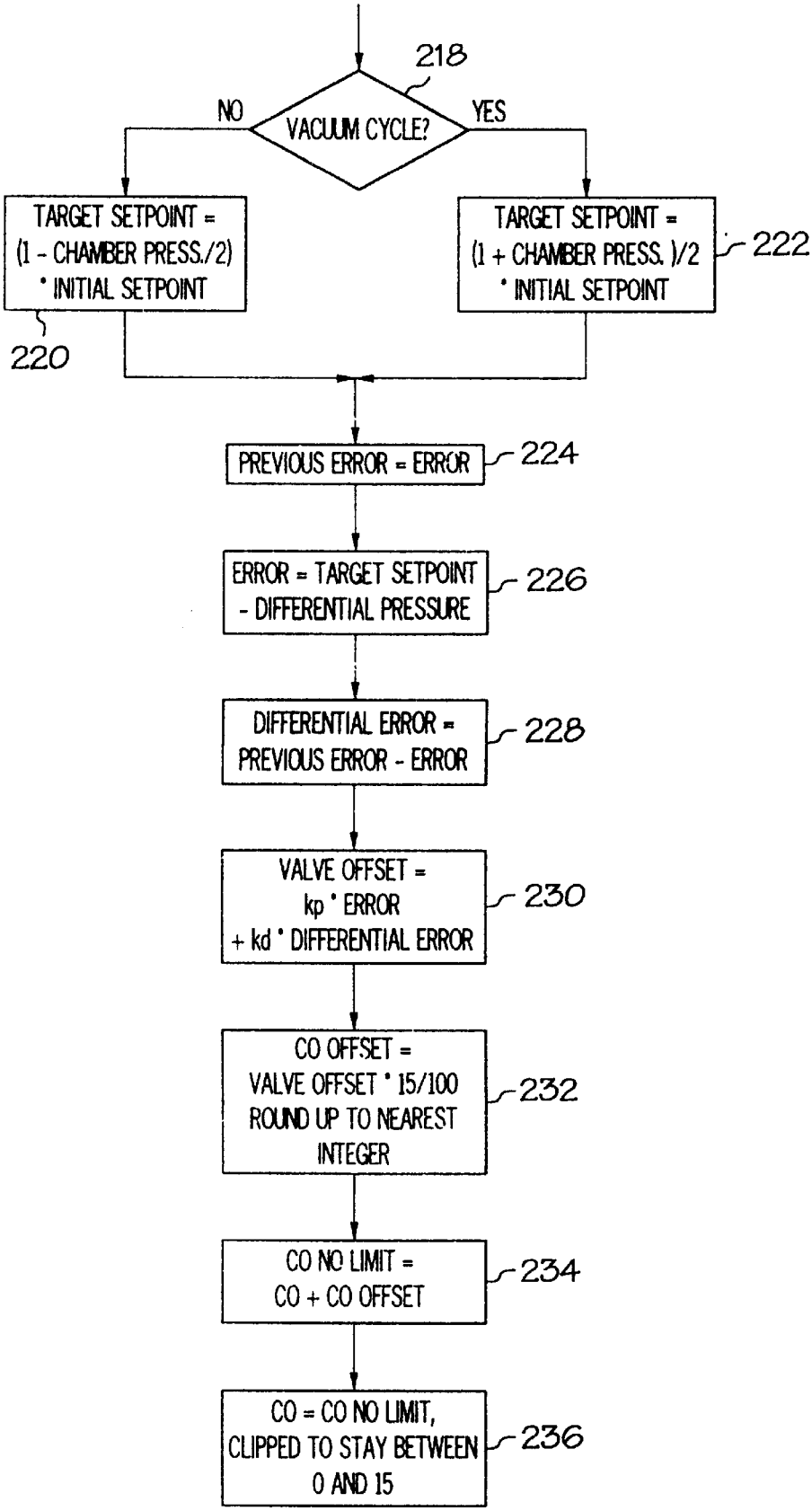
FIG. 23 is a flow chart showing the CO control adjust algorithm of the control algorithm of the present invention.

When the large headspace algorithm is selected, the vacuum steps are carried out by the CO (Chamber Orifice) large container vacuum control algorithm indicated at step 110, and the container is filled using the CO large headspace fill algorithm 112. The CO Vacuum Algorithm is illustrated more fully in FIG. 21. In the CO Vacuum Algorithm the PWM valves are generally set to as large a controllable value as possible, while maintaining the target differential pressure by adjusting the CO valves. Beginning with step 176, the valves are set to vacuum, i.e., to remove gas from the container and the chamber. Valve 418 is closed, and valve 414 is opened. The chamber orifice and PWM valves are initialized at values based on a look-up table based upon the PWMNL 250 value determined in step 106 of FIG. 17, illustrated in FIG. 25. While FIG. 25 includes settings for PWMNL 250 values less than 50, in the preferred embodiment, the small container algorithm would be used at these values. At step 178 a CO Control Adjust subalgorithm is executed. This algorithm is illustrated more fully in FIG. 23. The CO Control Adjust algorithm is similar in overall design and objectives to the PWM Control Adjust algorithm. When the vacuum cycle is being carried out, the differential pressure target is gradually decreased at step 220, and it is gradually decreased at step 222 when the fill cycle is being carried out. Error, differential error, and valve offset are calculated at steps 224, 226, 228 and 230. The chamber orifice valve offset is calculated at step 232, and the unclipped chamber orifice value (CO No Limit) is calculated at step 234. At step 236 the chamber orifice valve setting is clipped between 0 and 15, which are the minimum and maximum allowable values for the chamber orifice valves.

Figure 21:
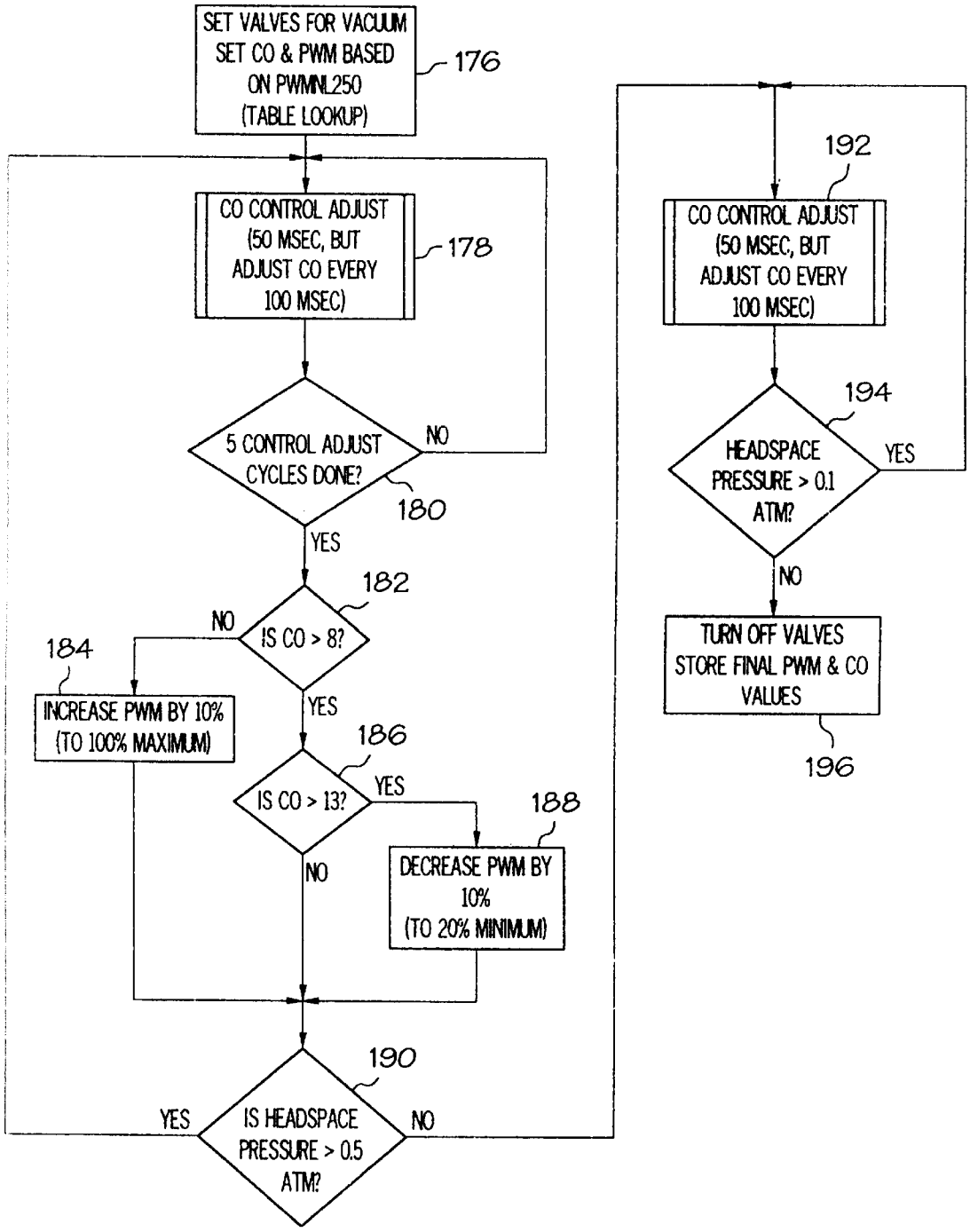
FIG. 21 is a flow chart showing the CO vacuum algorithm of the control algorithm of the present invention.

The large headspace CO vacuum adjustment algorithm is shown in FIG. 21. Five Control Adjust cycles are carried out at steps 178 and 180. Steps 182 and 186 check whether the chamber orifice valves are in a maximum controllable level, e.g., in this case between 8 and 13. If not, steps 184 or 188 take corrective measures by increasing the PWM valve setting, or decreasing the PWM valve setting, respectively. If the feedback control system adjusts the chamber valve outside an optimal range, these steps adjust the PWM valves settings to keep the valve control in the optimal range. At step 190 the control adjust steps 178, 180, 182, 184, 186, 188 are continually carried out until the head space pressure within the container is 0.5 atm or less. Once head space pressure is not greater than 0.5 atm, the CO Control Adjust step, at step 192, is carried out until head space pressure is not greater than 0.1 atm, as checked at step 194 but the PWM valves are maintained at their final setting in step 190 in order to maintain optimum initial valve setting for the fill algorithm. Once head space pressure is not greater than 0.1 atm the vacuum cycle is terminated, and the valves are turned off at step 196 and the final PWM and CO settings are stored for use in initiating the fill cycle.

Figure 22A:
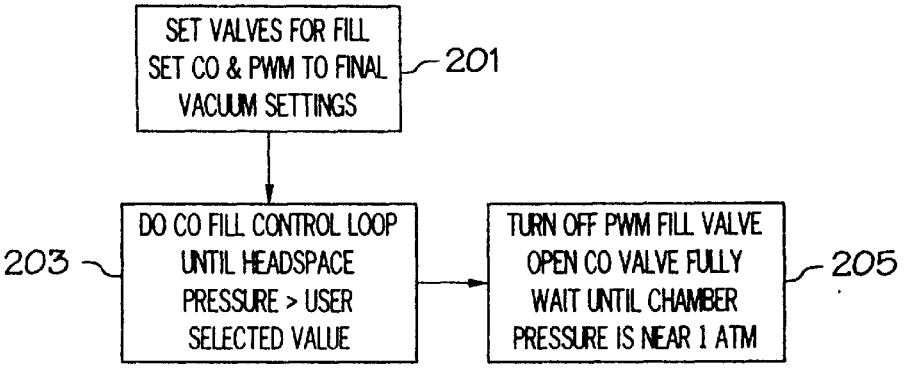
FIG. 22A is a flow chart showing the CO fill algorithm of the control algorithm of the present invention.
Figure 22B:
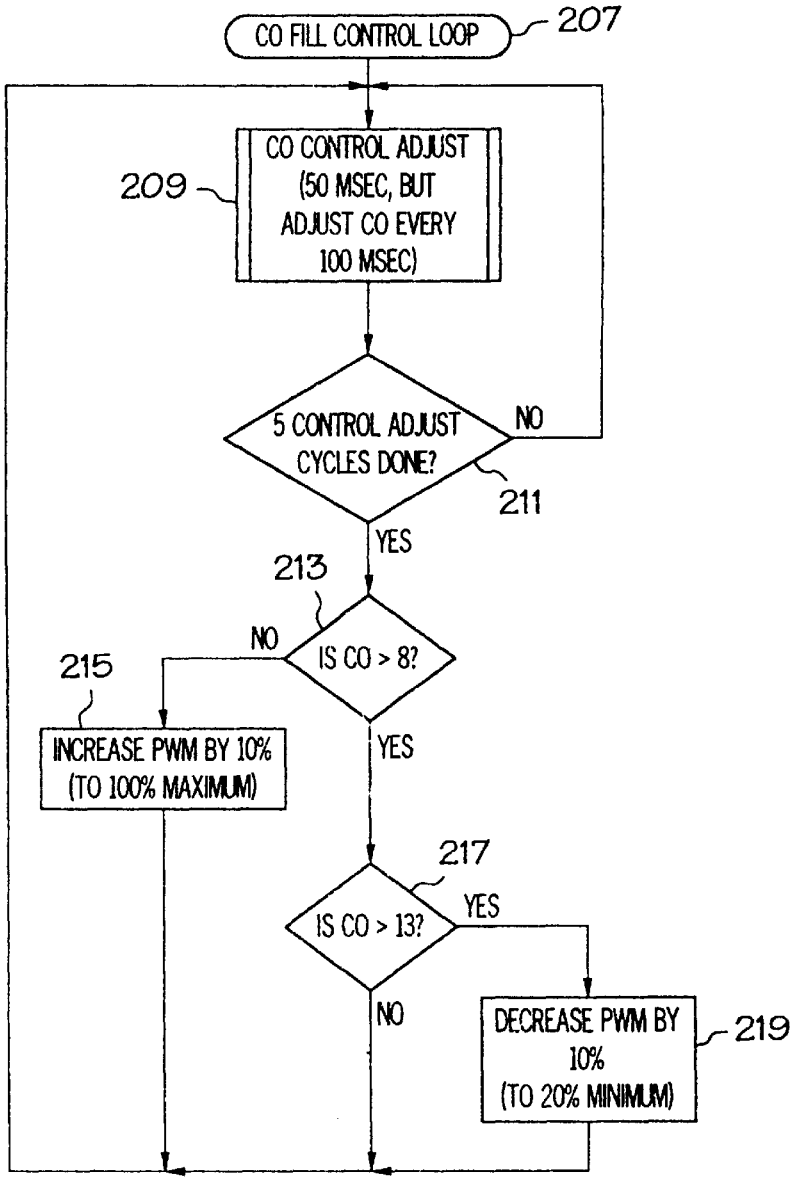
FIG. 22B is a flow chart showing the CO fill control loop of the control algorithm of the present invention.

The large headspace CO Fill Algorithm is more fully illustrated in FIGS. 22A and 22B. The process is initialized at step 201. The system valves are set to fill the container. At step 203 the CO fill control loop is carried out until the head space pressure reaches a user selected value. Once this occurs, the PWM fill valves are turned off, the chamber orifice valves are opened, and the system waits until the chamber pressure nears 1 atm, as controlled by step 205.

The CO fill control loop 203 of FIG. 22A is more fully illustrated in FIG. 22B. The CO fill control loop begins at step 207, and the CO Control Adjust 209 is carried out for 5 iterations, as controlled by step 211. The CO Control Adjust is executed every 50 ms but the control orifice valves are adjusted only every 100 ms so as not to wear out the chamber orifice valves. Steps 213, 215, 217, and 219 insure that the chamber orifice valves remain in a controllable range. At step 203 in FIG. 22A, the fill procedure continues until head space pressure reaches a user selected value. Once the head space pressure reaches the desired level, at step 205 the PWM fill valve is turned off and the chamber orifice valves are fully opened.

Certain errors which may occur during the gas exchange process are preferably accounted for in the algorithm. For example, corrective measures may be taken when the vacuum cycles or the fill cycle continue beyond a predetermined length of time such as when there is a leak in the system, or when the differential pressure exceeds acceptable limits. Additionally, the algorithm can accommodate the fact that a large container displaces more air in the chamber, thereby allowing the chamber to be evacuated more quickly than if a smaller container is used. Further, if it is so desired the algorithm may be controlled such that a small headspace fill algorithm may be used after the large headspace vacuum algorithm, and a large headspace fill algorithm may be used after a small headspace vacuum algorithm. It should also be noted that the selection of the large vs. small headspace algorithm is done merely for optimum performance of the apparatus. Either the small or large headspace algorithm may be used to control the gas exchange for all containers, regardless of size.

The controller is preferably programmed to account for periodic fluctuations in the head space and differential pressures that result from the operation of the PWM valves. For example, during the vacuum portion of the vacuum/fill cycle, when the PWM valve is on the head space pressure decreases linearly with time, and when the PWM valve is off the head space pressure remains constant. The PWM valve turns on and off at a periodic rate within the 50 ms cycle, and this action causes periodic fluctuations in both the head space pressure and the differential pressure readings. In order to account for these fluctuations, the system is programmed so that the pressure readings are taken at the same time in the PWM cycle for every pressure reading. In other words, the pressure readings are synchronized with the PWM valves to ensure pressure readings are taken at a consistent point in the PWM cycle preferably while the valves are off. This helps to reduce a source of error that would otherwise be present in the pressure readings.

BAROMETRIC COMPENSATION

It is desirable for the gas exchange apparatus to supply containers having a consistent final gas mixture in the container. Because the shut off parameters are calculated relative to measured atmospheric pressure, machine cycle and container characteristics are sensitive to barometric pressure. Changes in the atmospheric pressure can produce varying results. For example, in the presence of high atmospheric pressure, less of the container head space is evacuated before the apparatus reaches the target pressure during the vacuum step. Thus, there is less room for the replacement gas during the fill step, and the replacement gas is present in lower quantities than may be desired. In contrast, it is desirable to have consistent, repeatable percentages of the final fill gas mixture. In order to account for the changes in pressure, a sensor may be used to determine barometric pressure, and the "end" or "shut-off" chamber pressure may be determined as a percentage of the measured atmospheric pressure. It has been found that during low pressure weather conditions, the apparatus may attempt to extract more of the container atmosphere, which extends the time to complete the vacuum cycle (or perhaps, causes the apparatus to never meet the vacuum shut-off criteria). Accordingly, the use of an absolute pressure gauge allows one to measure and adjust for barometric pressure. This results in a consistent final fill gas composition and a more consistent machine cycle time for each container. Furthermore, each machine can be automatically calibrated for changes in barometric pressure due to usage in high or low altitudes.

The sequence of operations for the gas exchange apparatus of the present invention may be summarized as follows. Once a container 12 is properly oriented in the chamber 14, the corner switches 602, 604 are triggered and this prompts the system to initialize the apparatus by activating the vacuum pump 22 and turning on the fill gas valve. If the platform 550 is not in the down position, the platform 550 is then lowered.

Once the door 100 is closed by the operator such that switch 824 is triggered, the door is drawn in by the door in/out cylinder 820 and the platform 550 is raised until the top of the container is approximately ¼" from the ceiling of the chamber. The linear motion system 500 then lifts the gas exchange head 50 upwardly to remove the probes 54, 52 from the reservoir 310. The probes 54, 52 are then retracted within the intermediate cylinder 66 to strip off any unwanted seals that may remain on the probes from a previous gas exchange operation. Pressurized gas is then passed through the probes 52 and 54 to remove any sanitizing solution that may cling to the inner walls of the probes.

The gas exchange head is then moved to the seal pickup station 250 by the linear motion system 500. The gas exchange head 50 is shown as the gas exchange head 50' in this position in FIG. 3. The probes 54, 52 are moved downwardly until they are exposed below the intermediate sleeve 66. A seal is then picked up and retained on the seal pickup plate by contacting the seal with the seal pickup plate 74, passing a vacuum through the seal pickup plate, and "double hitting" the seal 18, as was discussed in greater detail above. With the seal on the probes 54, 52 and the seal pickup plate 74, the gas exchange head 50 is then positioned over the aperture 16 is the chamber 14 to thereby seal the chamber. The gas exchange head is shown as 50" in this position in FIG. 3.

The container 12 is supported by platform 550 in the chamber 14. The platform 550 is elevated to its position shown in FIG. 2 to move the container 12 near the ceiling of the chamber 14. A sensor 608 detects the top edge of the container to sense the elevation of the container. Typically, this sensor is located about ¾ inch below the ceiling of the chamber. Once this sensor detects the top edge of the container, the container is raised a predetermined distance such that the top of the container is at a fixed elevation in the chamber. A vacuum is then drawn in the chamber, which causes the outer lid or wrapping 20 of the container to puff outwardly, thereby drawing the lid or wrap taut and triggering the sensor 606 when it is sufficiently puffed. The probes 52, 54 are then lowered until they pierce the container. The chamber and the container are then evacuated and filled using the algorithms described above. Alternatively, after the vacuum and fill, the container may be vented to atmosphere for a specified time to achieve a desired appearance of the container.

The vacuum passed through the seal pickup plate 74 is then vented to atmosphere to allow the probes and gas exchange head to be retracted while leaving the seal on the container. When the gas exchange is completed, the flow probe 52 and sense probe 54 are then withdrawn and the seal 18 remains on the lid or wrapping 20 and maintains an effective seal on the container 12. The pickup plate 74 retains the seal 18 on the lid or wrapping as the probes are withdrawn. The platform 550 is then lowered until it is flush with the bottom of the chamber. Open cylinder 820 is then activated to open the door 100 to allow the operator access to the package. The gas exchange head is moved to the probe check station 200. Pressurized gas is then passed through the probes 52, 54 in a "blow-out" step to remove any debris that may be trapped in the probes. The integrity of the probes are then checked at the probe check station 200. The gas exchange head is next moved to the sanitize station 300 (FIG. 3), where the probes are immersed in sanitizing solution where they remain until the gas exchange process begins again. The carrier take-up roll is rotated until the next seal is positioned in the seal pickup block 280 for pickup by the gas exchange head. Once the door is opened by two-way cylinder 820 which displaces the door from the front of the chamber, cylinder .822 then rotates the torsion bar 810 (FIG. 4) such that the door 100 swings to a raised position, thereby signaling that the container can be removed from the chamber. When a new container 12 is placed into the chamber and the apparatus 10 is triggered to begin gas exchange operations, the gas exchange head 50 is moved from the sanitizing station 300.

It should be noted that a one or more gas exchange units as described above may be formed into a single integral machine. If the operator of a machine incorporating several gas exchange units favors one unit over the other units in the machine, the supplies (i.e. seals and sanitizing fluid) in that preferred unit will be depleted before the other units. Furthermore, due to heavier usage, the favored unit will tend to require more service than the others. Accordingly, a machine incorporating a control approach may be used wherein the operator is alerted that a specific unit is receiving more usage to encourage additional use of the other units. This allows the operator to be informed of the status of the machine, but allows the operator the option to continue to use any of the units.

In a preferred embodiment, a "token" is "passed" between multiple units in the machine. The machine that has the token is the preferred unit, which is signified to the operator by a flashing green light. For the non-preferred units, which are also available for use, the green light is on but not flashing. After the preferred machine is used, the token is passed to another unit in a sequence that supports a natural work flow.

While the forms of the apparatus herein described constitute a preferred embodiment of the invention, it is to be understood that the present invention is not limited to these precise forms and that changes may be made therein without departing from the scope of the invention.

What is claimed is:

1. A method for controlling an apparatus for exchanging a first gas contained in a sealed container for a second gas while the container is in a chamber, the method comprising the steps of:

withdrawing the first gas from said container for a predetermined period of time;

measuring a change in pressure in said container during at least part of said predetermined period of time:

approximating the head space volume of said container based directly or indirectly upon said measured change in pressure; and withdrawing the first gas from said container and air from said chamber under conditions which are dependent upon the approximation of said headspace volume and which reduce the damage to said container due to pressure forces.

2. The method of claim 1 including the additional steps of releasing a second gas into said container and venting said chamber under conditions which are dependent upon the approximation of said headspace volume and which reduce the damage to said container due to pressure forces.

3. The method of claim 2 wherein the initial rate of withdrawing the first gas from said container and the initial rate of releasing the second gas into said container are selected based upon said head space volume approximation.

4. The method of claim 3 further comprising the step of selecting a large headspace procedure or a small headspace procedure based upon said approximation wherein the rates with which the first gas is withdrawn from said container and air is withdrawn from said chamber and the rate with which said second gas is released into said container and air is released into said chamber depends on whether said large headspace procedure or said small headspace procedure is selected.

5. The method of claim 4 wherein when withdrawing gas from said container and said chamber and when releasing gas into said container and said chamber, said container pressure is higher than said chamber pressure.

6. The method of claim 5 wherein said large headspace procedure includes setting the gas flow rate out of said container during said withdrawing step and the gas flow rate into said container during said releasing step to a maximum controllable level while adjusting the gas flow rate into and out of said chamber.

7. The method of claim 5 wherein said small headspace procedure includes setting the gas flow rate out of said chamber during said withdrawing step and the gas flow rate into said chamber during said releasing step to a maximum controllable level while adjusting the rate of gas flow into and out of said container.

8. The method of claim 5 wherein a target pressure differential between the pressure in said container and the pressure in said chamber is set to an initial value upon commencing the step of withdrawing the first gas from said container or upon commencing the step of releasing the second gas into said container and said target differential is gradually decreased as said withdrawing or releasing step is continued and said method includes the step of monitoring the pressure in said chamber and said container.

9. The method of claim 8 wherein during said steps of withdrawing said first gas and releasing said second gas, the flow rate of gas into and out of said container is controlled by a set of pulse width modulated valves.

10. The method of claim 9 wherein the flow rate of gas into and out of said chamber is controlled by a set of binary weighted orifice valves.

11. The method of claim 10 wherein said pulse width modulated valves have a predetermined control cycle and wherein the step of monitoring the pressure in said container is synchronized with said pulse width modulated valves such that said pressure-measuring steps occur at a time when said pulse width modulated valves are closed.

12. The method of claim 11 wherein said step of selecting said large headspace procedure or said small headspace procedure comprises the steps of setting said pulse width modulated valves and said chamber orifice valves to a predetermined level, withdrawing said first gas from said container and withdrawing air from said chamber for a predetermined period of time, comparing said differential pressure to a predetermined differential pressure value, and selecting said large headspace procedure or said small headspace procedure based on said comparison.

13. The method of claim 11 wherein said step of selecting said large headspace procedure or said small headspace procedure comprises the steps of setting said pulse width modulated valves and said chamber orifice valves to a predetermined level, withdrawing said first gas from said container and withdrawing air from said chamber for a predetermined period of time, adjusting said pulse width modulated valves during said withdrawing step, and selecting said large headspace procedure or said small headspace procedure based on said pulse width modulated valve setting after said adjusting step.

14. The method of claim 13 wherein the step of withdrawing the first gas from said container is terminated upon reaching a predetermined pressure in said container relative to a measured atmospheric pressure.

15. The method of claim 1 wherein the headspace pressure in said container is maintained generally constant during said first withdrawing step.

16. The method of claim 1 wherein said chamber is part of said apparatus.

17. The method of claim 1 wherein said approximating step includes the steps of withdrawing gas from said chamber while simultaneously withdrawing gas from said container for a predetermined period of time, measuring the difference in pressure between said container and said chamber, and comparing said measured differential pressure to a look up table.

18. The method of claim 1 wherein said chamber is sealed relative the surrounding atmosphere during both withdrawing steps and the approximating step.

* * * * *